US008721471B2

(12) United States Patent
Albertsen et al.

(10) Patent No.: US 8,721,471 B2
(45) **Date of Patent: *May 13, 2014**

(54) HOLLOW GOLF CLUB HEAD HAVING SOLE STRESS REDUCING FEATURE

(71) Applicant: Taylor Made Golf Company, Inc., Carlsbad, CA (US)

(72) Inventors: Jeffrey J. Albertsen, Plano, TX (US); Michael Scott Burnett, McKinney, TX (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/949,586

(22) Filed: Jul. 24, 2013

(65) Prior Publication Data

US 2013/0310194 A1 Nov. 21, 2013

Related U.S. Application Data

(63) Continuation of application No. 13/543,921, filed on Jul. 9, 2012, now Pat. No. 8,517,860, which is a continuation of application No. 13/324,093, filed on Dec. 13, 2011, now Pat. No. 8,241,143, which is a continuation of application No. 12/791,025, filed on Jun. 1, 2010, now Pat. No. 8,235,844.

(51) Int. Cl.
*A63B 53/04* (2006.01)

(52) U.S. Cl.
USPC ..... 473/328; 473/329; 473/322; 473/345; 473/350

(58) Field of Classification Search
USPC ..... 473/324–350
See application file for complete search history.

(56) References Cited

U.S. PATENT DOCUMENTS

| | | | |
|---|---|---|---|
| 708,575 | A | 9/1902 | Mules |
| 727,819 | A | 5/1903 | Mattern |
| 819,900 | A | 5/1906 | Martin |
| 1,538,312 | A | 5/1925 | Beat |
| 1,705,997 | A | 3/1929 | Quynn |
| 2,004,968 | A | 6/1935 | Young |
| 2,034,936 | A | 3/1936 | Barnhart |
| 2,198,981 | A | 4/1940 | Sullivan |

(Continued)

FOREIGN PATENT DOCUMENTS

| | | | |
|---|---|---|---|
| CN | 2436182 | Y | 6/2001 |
| CN | 201353407 | Y | 12/2009 |

(Continued)

OTHER PUBLICATIONS

Mike Stachura, "The Hot List", Golf Digest Magazine, Feb. 2004, pp. 82-86.

(Continued)

*Primary Examiner* — Alvin Hunter
(74) *Attorney, Agent, or Firm* — David J. Dawsey; Michael J. Gallagher; Gallagher & Dawsey Co., LPA

(57) ABSTRACT

A hollow golf club head incorporating a stress reducing feature including a sole located stress reducing feature. The location and size of the sole stress reducing feature, and their relationship to one another and other club head engineering variables, play a significant role in selectively influencing deflection of the face.

28 Claims, 24 Drawing Sheets

(56) References Cited

U.S. PATENT DOCUMENTS

| | | | |
|---|---|---|---|
| 2,328,583 | A | 9/1943 | Reach |
| 2,332,342 | A | 10/1943 | Reach |
| 2,968,486 | A | 1/1961 | Jackson |
| 3,084,940 | A | 4/1963 | Cissel |
| 3,085,804 | A | 4/1963 | Pieper |
| 3,166,320 | A | 1/1965 | Onions |
| 3,893,672 | A | 7/1975 | Schonher |
| 3,970,236 | A | 7/1976 | Rogers |
| 3,985,363 | A | 10/1976 | Jepson et al. |
| 3,997,170 | A | 12/1976 | Goldberg |
| 4,027,885 | A | 6/1977 | Rogers |
| 4,065,133 | A | 12/1977 | Gordos |
| 4,077,633 | A | 3/1978 | Studen |
| 4,139,196 | A | 2/1979 | Riley |
| 4,147,349 | A | 4/1979 | Jeghers |
| 4,165,076 | A | 8/1979 | Cella |
| 4,193,601 | A | 3/1980 | Reid, Jr. et al. |
| D256,709 | S | 9/1980 | Reid, Jr. et al. |
| 4,247,105 | A | 1/1981 | Jeghers |
| 4,398,965 | A | 8/1983 | Campau |
| 4,431,192 | A | 2/1984 | Stuff, Jr. |
| 4,527,799 | A | 7/1985 | Solheim |
| 4,592,552 | A | 6/1986 | Garber |
| D285,473 | S | 9/1986 | Flood |
| 4,754,974 | A | 7/1988 | Kobayashi |
| 4,787,636 | A | 11/1988 | Honma |
| 4,881,739 | A | 11/1989 | Garcia |
| 4,895,367 | A | 1/1990 | Kajita et al. |
| 4,919,428 | A | 4/1990 | Perkins |
| 5,076,585 | A | 12/1991 | Bouquet |
| D323,035 | S | 1/1992 | Yang |
| 5,092,599 | A | 3/1992 | Okumoto et al. |
| 5,116,054 | A | 5/1992 | Johnson |
| 5,172,913 | A | 12/1992 | Bouquet |
| 5,190,289 | A | 3/1993 | Nagai et al. |
| 5,193,810 | A | 3/1993 | Antonious |
| 5,203,565 | A | 4/1993 | Murray et al. |
| 5,221,086 | A | 6/1993 | Antonious |
| 5,255,919 | A | 10/1993 | Johnson |
| 5,301,944 | A | 4/1994 | Koehler |
| 5,316,305 | A | 5/1994 | McCabe |
| 5,318,297 | A | 6/1994 | Davis et al. |
| 5,340,106 | A | 8/1994 | Ravaris |
| 5,437,456 | A | 8/1995 | Schmidt et al. |
| D366,508 | S | 1/1996 | Hutin |
| 5,482,280 | A | 1/1996 | Yamawaki |
| 5,492,327 | A | 2/1996 | Biafore, Jr. |
| 5,511,786 | A | 4/1996 | Antonious |
| D372,512 | S | 8/1996 | Simmons |
| 5,558,332 | A | 9/1996 | Cook |
| D375,130 | S | 10/1996 | Hlinka et al. |
| 5,564,705 | A | 10/1996 | Kobayashi et al. |
| D377,509 | S | 1/1997 | Katayama |
| D378,770 | S | 4/1997 | Hlinka et al. |
| 5,616,088 | A | 4/1997 | Aizawa et al. |
| 5,632,695 | A | 5/1997 | Hlinka et al. |
| D382,612 | S | 8/1997 | Oyer |
| 5,695,412 | A | 12/1997 | Cook |
| 5,700,208 | A | 12/1997 | Nelms |
| 5,735,754 | A | 4/1998 | Antonious |
| D394,688 | S | 5/1998 | Fox |
| 5,749,795 | A | 5/1998 | Schmidt et al. |
| 5,759,114 | A | 6/1998 | Bluto et al. |
| 5,772,527 | A | 6/1998 | Liu |
| 5,785,608 | A | 7/1998 | Collins |
| D397,750 | S | 9/1998 | Frazetta |
| 5,830,084 | A | 11/1998 | Kosmatka |
| D403,037 | S | 12/1998 | Stone et al. |
| D405,488 | S | 2/1999 | Burrows |
| 5,876,293 | A | 3/1999 | Musty |
| 5,885,166 | A | 3/1999 | Shiraishi |
| 5,890,971 | A | 4/1999 | Shiraishi |
| 5,935,020 | A | 8/1999 | Stites et al. |
| D413,952 | S | 9/1999 | Oyer |
| 5,954,595 | A | 9/1999 | Antonious |
| 6,001,029 | A | 12/1999 | Kobayashi |
| 6,033,319 | A | 3/2000 | Farrar |
| 6,042,486 | A | 3/2000 | Gallagher |
| 6,048,278 | A | 4/2000 | Meyer et al. |
| 6,074,308 | A | 6/2000 | Domas |
| 6,083,115 | A | 7/2000 | King |
| 6,086,485 | A | 7/2000 | Hamada et al. |
| 6,093,113 | A | 7/2000 | Mertens |
| 6,123,627 | A | 9/2000 | Antonious |
| 6,146,286 | A | 11/2000 | Masuda |
| 6,168,537 | B1 | 1/2001 | Ezawa |
| 6,244,976 | B1 | 6/2001 | Murphy et al. |
| 6,325,728 | B1 | 12/2001 | Helmstetter et al. |
| 6,332,847 | B2 | 12/2001 | Murphy et al. |
| 6,334,818 | B1 | 1/2002 | Cameron et al. |
| 6,348,013 | B1 | 2/2002 | Kosmatka |
| 6,354,962 | B1 | 3/2002 | Galloway et al. |
| 6,368,234 | B1 | 4/2002 | Galloway |
| 6,371,868 | B1 | 4/2002 | Galloway et al. |
| 6,386,990 | B1 | 5/2002 | Reyes et al. |
| 6,390,933 | B1 | 5/2002 | Galloway et al. |
| 6,398,666 | B1 | 6/2002 | Evans et al. |
| 6,406,378 | B1 | 6/2002 | Murphy et al. |
| 6,435,977 | B1 | 8/2002 | Helmstetter et al. |
| 6,440,008 | B2 | 8/2002 | Murphy et al. |
| 6,458,042 | B1 | 10/2002 | Chen |
| 6,464,598 | B1 | 10/2002 | Miller |
| 6,471,604 | B2 | 10/2002 | Hocknell et al. |
| 6,478,692 | B2 | 11/2002 | Kosmatka |
| 6,482,106 | B2 | 11/2002 | Saso |
| 6,491,592 | B2 | 12/2002 | Cackett et al. |
| 6,508,978 | B1 | 1/2003 | Deshmukh |
| 6,524,194 | B2 | 2/2003 | McCabe |
| 6,527,650 | B2 | 3/2003 | Reyes et al. |
| 6,530,847 | B1 | 3/2003 | Antonious |
| 6,547,676 | B2 | 4/2003 | Cackett et al. |
| 6,565,452 | B2 | 5/2003 | Helmstetter et al. |
| 6,572,489 | B2 | 6/2003 | Miyamoto et al. |
| 6,575,845 | B2 | 6/2003 | Galloway et al. |
| 6,582,323 | B2 | 6/2003 | Soracco et al. |
| 6,592,466 | B2 | 7/2003 | Helmstetter et al. |
| 6,602,149 | B1 | 8/2003 | Jacobson |
| 6,607,452 | B2 | 8/2003 | Helmstetter et al. |
| 6,612,398 | B1 | 9/2003 | Tokimatsu et al. |
| 6,616,547 | B2 | 9/2003 | Vincent et al. |
| 6,620,056 | B2 | 9/2003 | Galloway et al. |
| D482,089 | S | 11/2003 | Burrows |
| D482,090 | S | 11/2003 | Burrows |
| D482,420 | S | 11/2003 | Burrows |
| D484,208 | S | 12/2003 | Burrows |
| 6,663,504 | B2 | 12/2003 | Hocknell et al. |
| 6,669,576 | B1 | 12/2003 | Rice |
| 6,669,577 | B1 | 12/2003 | Hocknell et al. |
| 6,669,578 | B1 | 12/2003 | Evans |
| 6,676,536 | B1 | 1/2004 | Jacobson |
| 6,679,786 | B2 | 1/2004 | McCabe |
| D486,542 | S | 2/2004 | Burrows |
| 6,716,114 | B2 | 4/2004 | Nishio |
| 6,719,645 | B2 | 4/2004 | Kouno |
| 6,723,002 | B1 | 4/2004 | Barlow |
| 6,739,982 | B2 | 5/2004 | Murphy et al. |
| 6,758,763 | B2 | 7/2004 | Murphy et al. |
| 6,773,359 | B1 | 8/2004 | Lee |
| 6,776,726 | B2 | 8/2004 | Sano |
| 6,783,465 | B2 | 8/2004 | Matsunaga |
| 6,800,040 | B2 | 10/2004 | Galloway et al. |
| 6,811,496 | B2 | 11/2004 | Wahl et al. |
| 6,821,214 | B2 | 11/2004 | Rice |
| D501,036 | S | 1/2005 | Burrows |
| D501,523 | S | 2/2005 | Dogan et al. |
| D501,903 | S | 2/2005 | Tanaka |
| 6,855,068 | B2 | 2/2005 | Antonious |
| 6,860,824 | B2 | 3/2005 | Evans |
| D504,478 | S | 4/2005 | Burrows |
| 6,875,130 | B2 | 4/2005 | Nishio |
| 6,887,165 | B2 | 5/2005 | Tsurumaki |
| D506,236 | S | 6/2005 | Evans et al. |
| 6,902,497 | B2 | 6/2005 | Deshmukh et al. |
| D508,274 | S | 8/2005 | Burrows |

(56) References Cited

U.S. PATENT DOCUMENTS

D508,275 S 8/2005 Burrows
6,932,717 B2 8/2005 Hou et al.
6,994,636 B2 2/2006 Hocknell et al.
6,994,637 B2 2/2006 Murphy et al.
7,004,849 B2 2/2006 Cameron
7,025,692 B2 4/2006 Erickson et al.
D520,585 S 5/2006 Hasebe
D523,104 S 6/2006 Hasebe
7,070,512 B2 7/2006 Nishio
7,070,517 B2 7/2006 Cackett et al.
7,077,762 B2 7/2006 Kouno et al.
7,082,665 B2 8/2006 Deshmukh et al.
7,097,572 B2 8/2006 Yabu
7,101,289 B2 9/2006 Gibbs et al.
7,112,148 B2 9/2006 Deshmukh
7,118,493 B2 10/2006 Galloway
7,121,957 B2 10/2006 Hocknell et al.
7,125,344 B2 10/2006 Hocknell et al.
7,128,661 B2 10/2006 Soracco et al.
7,134,971 B2 11/2006 Franklin et al.
7,137,907 B2 11/2006 Gibbs et al.
7,144,334 B2 12/2006 Ehlers et al.
7,156,750 B2 1/2007 Nishitani et al.
7,163,470 B2 1/2007 Galloway et al.
7,169,058 B1 1/2007 Fagan
D536,402 S 2/2007 Kawami
D543,600 S 5/2007 Oldknow
7,211,005 B2 5/2007 Lindsay
7,211,006 B2 5/2007 Chang
7,214,143 B2 5/2007 Deshmukh
D544,939 S 6/2007 Radcliffe et al.
7,226,366 B2 6/2007 Galloway
7,250,007 B2 7/2007 Lu
7,252,600 B2 8/2007 Murphy et al.
7,258,626 B2 8/2007 Gibbs et al.
7,258,631 B2 8/2007 Galloway et al.
D552,701 S 10/2007 Ruggiero et al.
7,278,927 B2 10/2007 Gibbs et al.
7,281,985 B2 10/2007 Galloway
D554,720 S 11/2007 Barez et al.
7,291,074 B2 11/2007 Kouno et al.
7,294,064 B2 11/2007 Tsurumaki et al.
7,297,072 B2 11/2007 Meyer et al.
7,303,488 B2 12/2007 Kakiuchi et al.
7,306,527 B2 12/2007 Williams et al.
7,314,418 B2 1/2008 Galloway et al.
7,318,782 B2 1/2008 Imamoto et al.
7,320,646 B2 1/2008 Galloway
D561,286 S 2/2008 Morales et al.
7,344,452 B2 3/2008 Imamoto et al.
7,347,795 B2 3/2008 Yamgishi et al.
7,354,355 B2 4/2008 Tavares et al.
7,387,577 B2 6/2008 Murphy et al.
7,390,266 B2 6/2008 Gwon
7,396,293 B2 7/2008 Soracco
7,396,296 B2 7/2008 Evans et al.
7,402,112 B2 7/2008 Galloway et al.
7,407,448 B2 8/2008 Stevens et al.
7,413,520 B1 8/2008 Hocknell et al.
D577,090 S 9/2008 Pergande et al.
D579,507 S 10/2008 Llewellyn et al.
7,431,667 B2 10/2008 Vincent et al.
7,438,647 B1 10/2008 Hocknell
7,438,649 B2 10/2008 Ezaki et al.
7,455,598 B2 11/2008 Williams et al.
7,470,201 B2 12/2008 Nakahara et al.
D584,784 S 1/2009 Barez et al.
7,476,161 B2 1/2009 Williams et al.
7,491,134 B2 2/2009 Murphy et al.
D588,223 S 3/2009 Kuan
7,497,787 B2 3/2009 Murphy et al.
7,500,924 B2 3/2009 Yokota
D592,723 S 5/2009 Chau et al.
7,530,901 B2 5/2009 Imamoto et al.
7,549,935 B2 6/2009 Foster et al.
7,572,193 B2 8/2009 Yokota
7,578,751 B2 8/2009 Williams et al.
D600,767 S 9/2009 Horacek et al.
7,582,024 B2 9/2009 Shear
D604,784 S 11/2009 Horacek et al.
7,632,196 B2 12/2009 Reed et al.
7,682,264 B2 3/2010 Hsu et al.
7,717,807 B2 5/2010 Evans et al.
D616,952 S 6/2010 Oldknow
7,749,096 B2 7/2010 Gibbs et al.
7,749,097 B2 7/2010 Foster et al.
7,815,520 B2 10/2010 Frame et al.
7,857,711 B2 12/2010 Shear
D631,119 S 1/2011 Albertsen et al.
7,867,105 B2 1/2011 Moon
7,988,565 B2 8/2011 Abe
8,083,609 B2 12/2011 Burnett et al.
8,088,021 B2 1/2012 Albertsen et al.
8,162,775 B2 4/2012 Tavares et al.
8,216,087 B2 7/2012 Breier et al.
8,235,844 B2 8/2012 Albertsen et al.
8,241,143 B2 8/2012 Albertsen et al.
8,241,144 B2 8/2012 Albertsen et al.
8,403,771 B1 3/2013 Rice et al.
8,517,860 B2 * 8/2013 Albertsen et al. ..... 473/329
2002/0115501 A1 8/2002 Chen
2002/0183130 A1 12/2002 Pacinella
2002/0183134 A1 12/2002 Allen et al.
2003/0013545 A1 1/2003 Vincent et al.
2003/0176238 A1 9/2003 Galloway et al.
2003/0220154 A1 11/2003 Anelli
2004/0121852 A1 6/2004 Tsurumaki
2004/0176180 A1 9/2004 Yamaguchi et al.
2004/0192463 A1 9/2004 Tsurumaki et al.
2005/0003905 A1 1/2005 Kim et al.
2005/0026716 A1 2/2005 Wahl et al.
2005/0049081 A1 3/2005 Boone
2005/0119070 A1 6/2005 Kumamoto
2006/0009305 A1 1/2006 Lindsay
2006/0052177 A1 3/2006 Nakahara et al.
2006/0073910 A1 4/2006 Imamoto et al.
2006/0084525 A1 4/2006 Imamoto et al.
2006/0094535 A1 5/2006 Cameron
2006/0281581 A1 12/2006 Yamamoto
2007/0026961 A1 2/2007 Hou
2007/0049416 A1 3/2007 Shear
2007/0082751 A1 4/2007 Lo et al.
2007/0117648 A1 5/2007 Yokota
2007/0275792 A1 11/2007 Horacek et al.
2009/0286622 A1 11/2009 Yokota
2010/0029404 A1 2/2010 Shear
2010/0113176 A1 5/2010 Boyd et al.
2010/0178997 A1 7/2010 Gibbs et al.
2011/0021284 A1 1/2011 Stites et al.
2011/0151997 A1 6/2011 Shear
2011/0218053 A1 9/2011 Tang et al.
2011/0244979 A1 10/2011 Snyder
2011/0281663 A1 11/2011 Stites et al.
2011/0281664 A1 11/2011 Boyd et al.
2011/0294599 A1 12/2011 Albertsen et al.
2012/0034997 A1 2/2012 Swartz
2012/0083362 A1 4/2012 Albertsen et al.
2012/0083363 A1 4/2012 Albertsen et al.
2012/0135821 A1 5/2012 Boyd et al.
2012/0142447 A1 6/2012 Boyd et al.
2012/0142452 A1 6/2012 Burnett et al.
2012/0178548 A1 7/2012 Tavares et al.
2012/0196701 A1 8/2012 Stites et al.
2012/0196703 A1 8/2012 Sander
2012/0244960 A1 9/2012 Tang et al.
2012/0270676 A1 10/2012 Burnett et al.
2012/0277029 A1 11/2012 Albertsen et al.
2012/0277030 A1 11/2012 Albertsen et al.

FOREIGN PATENT DOCUMENTS

JP 01091876 A2 4/1989
JP 03049777 A 3/1991
JP 03151988 A 6/1991

(56) References Cited

FOREIGN PATENT DOCUMENTS

| | | | |
|---|---|---|---|
| JP | 04180778 | A | 6/1992 |
| JP | 4180778 | A2 | 6/1992 |
| JP | 05337220 | A | 12/1993 |
| JP | 06182004 | A | 7/1994 |
| JP | 06190088 | | 7/1994 |
| JP | 06285186 | A | 10/1994 |
| JP | 08117365 | A | 5/1996 |
| JP | 10155943 | A | 6/1998 |
| JP | 10263118 | A | 10/1998 |
| JP | 11-155982 | | 6/1999 |
| JP | 2000167089 | A | 6/2000 |
| JP | 2000288131 | A | 10/2000 |
| JP | 2000300701 | A | 10/2000 |
| JP | 2000342721 | A | 12/2000 |
| JP | 2000014841 | A | 1/2001 |
| JP | 2001231888 | A | 8/2001 |
| JP | 2002052099 | | 2/2002 |
| JP | 2002248183 | A | 9/2002 |
| JP | 2002248183 | A | 9/2002 |
| JP | 2003024481 | A | 1/2003 |
| JP | 2003093554 | | 4/2003 |
| JP | 2003210627 | A | 7/2003 |
| JP | 2004174224 | | 6/2004 |
| JP | 2004275700 | | 10/2004 |
| JP | 2004313762 | | 11/2004 |
| JP | 2004-351054 | | 12/2004 |
| JP | 2004351173 | | 12/2004 |
| JP | 2005193069 | | 7/2005 |
| JP | 2007136069 | | 6/2007 |
| JP | 2007275253 | A | 10/2007 |
| JP | 4128970 | | 7/2008 |
| JP | 2009000281 | A | 1/2009 |
| JP | 2010029590 | A | 2/2010 |
| JP | 2010279847 | A | 12/2010 |
| JP | 2011024999 | A | 2/2011 |

OTHER PUBLICATIONS

Mike Stachura, "The Hot List", Golf Digest Magazine, Feb. 2005, pp. 120-130.
Mike Stachura, "The Hot List", Golf Digest Magazine, Feb. 2005, pp. 131-143.
Mike Stachura, "The Hot List", Golf Digest Magazine, Feb. 2006, pp. 122-132.
Mike Stachura, "The Hot List", Golf Digest Magazine, Feb. 2006, pp. 133-143.
Mike Stachura, "The Hot List", Golf Digest Magazine, Feb. 2007, pp. 130-151.
"The Hot List", Golf Digest Magazine, Feb. 2008, pp. 114-139.
Mike Stachura, Stina Sternberg, "Editor's Choices and Gold Medal Drivers", Golf Digest Magazine, Feb. 2010, pp. 95-109.
The Hot List, Golf Digest Magazine, Feb. 2009, pp. 101-127.
International Searching Authority (USPTO), International Search Report and Written Opinion for International Application No. PCT/US2011/038150, mailed Sep. 16, 2011, 13 pages.

* cited by examiner

HOLLOW GOLF CLUB HEAD HAVING SOLE STRESS REDUCING FEATURE

CROSS-REFERENCE TO RELATED APPLICATIONS

This application is a continuation of U.S. nonprovisional application Ser. No. 13/543,921, filed on Jul. 9, 2012, which is a continuation of U.S. nonprovisional application Ser. No. 13/324,093, now U.S. Pat. No. 8,241,143, filed on Dec. 13, 2011, which is a continuation of U.S. nonprovisional application Ser. No. 12/791,025, now U.S. Pat. No. 8,235,844, filed on Jun. 1, 2010, all of which is incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to the field of golf clubs, namely hollow golf club heads. The present invention is a hollow golf club head characterized by a stress reducing feature that includes a crown located stress reducing feature and a sole located stress reducing feature.

BACKGROUND OF THE INVENTION

The impact associated with a golf club head, often moving in excess of 100 miles per hour, impacting a stationary golf ball results in a tremendous force on the face of the golf club head, and accordingly a significant stress on the face. It is desirable to reduce the peak stress experienced by the face and to selectively distribute the force of impact to other areas of the golf club head where it may be more advantageously utilized.

SUMMARY OF INVENTION

In its most general configuration, the present invention advances the state of the art with a variety of new capabilities and overcomes many of the shortcomings of prior methods in new and novel ways. In its most general sense, the present invention overcomes the shortcomings and limitations of the prior art in any of a number of generally effective configurations.

The present golf club incorporating a stress reducing feature including a crown located SRF, short for stress reducing feature, located on the crown of the club head and a sole located SRF located on the sole of the club head. The location and size of the SRFs, and their relationship to one another, play a significant role in reducing the peak stress seen on the golf club's face during an impact with a golf ball, as well as selectively increasing deflection of the face.

Numerous variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Figure 1:
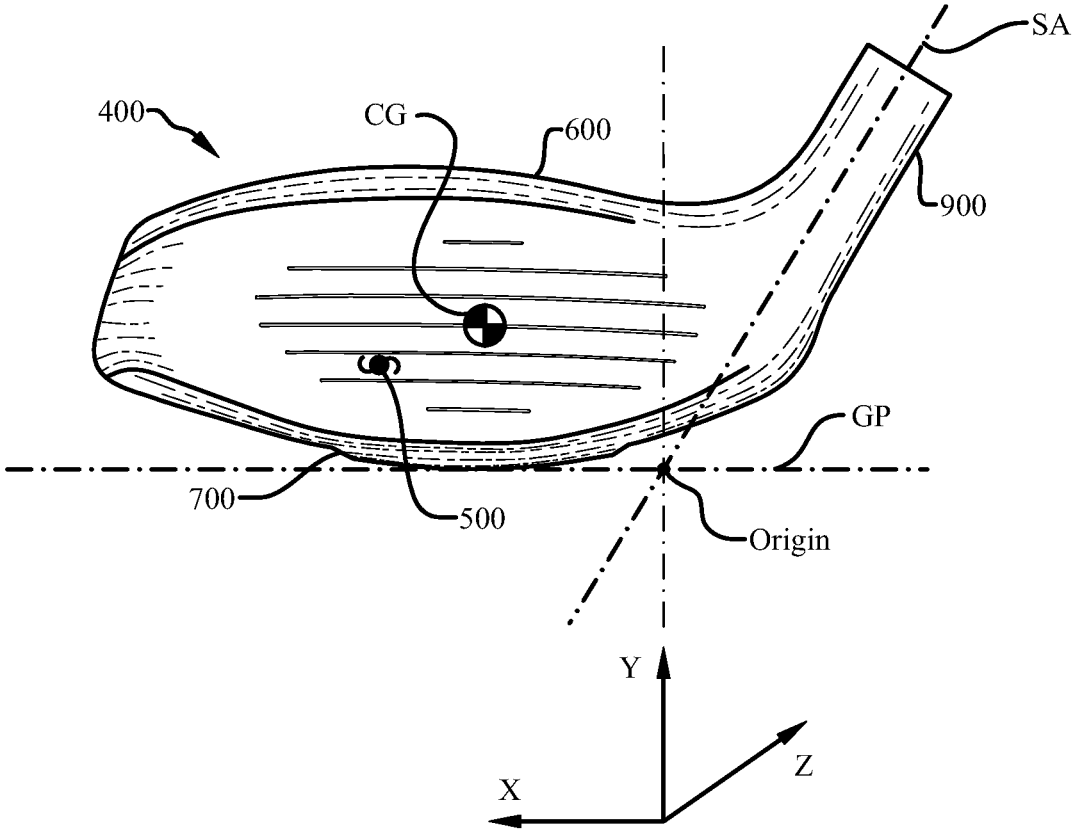
FIG. 1 shows a front elevation view of an embodiment of the present invention, not to scale.

These drawings are provided to assist in the understanding of the exemplary embodiments of the present golf club as described in more detail below and should not be construed as unduly limiting the golf club. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The hollow golf club of the present invention enables a significant advance in the state of the art. The preferred embodiments of the golf club accomplish this by new and novel methods that are configured in unique and novel ways and which demonstrate previously unavailable, but preferred and desirable capabilities. The description set forth below in connection with the drawings is intended merely as a description of the presently preferred embodiments of the golf club, and is not intended to represent the only form in which the present golf club may be constructed or utilized. The description sets forth the designs, functions, means, and methods of implementing the golf club in connection with the illustrated embodiments. It is to be understood, however, that the same or equivalent functions and features may be accomplished by different embodiments that are also intended to be encompassed within the spirit and scope of the claimed golf club head.

In order to fully appreciate the present disclosed golf club some common terms must be defined for use herein. First, one of skill in the art will know the meaning of "center of gravity," referred to herein as CG, from an entry level course on the mechanics of solids. With respect to wood-type golf clubs, hybrid golf clubs, and hollow iron type golf clubs, which are may have non-uniform density, the CG is often thought of as the intersection of all the balance points of the club head. In other words, if you balance the head on the face and then on the sole, the intersection of the two imaginary lines passing straight through the balance points would define the point referred to as the CG.

It is helpful to establish a coordinate system to identify and discuss the location of the CG. In order to establish this coordinate system one must first identify a ground plane (GP) and a shaft axis (SA). First, the ground plane (GP) is the horizontal plane upon which a golf club head rests, as seen best in a front elevation view of a golf club head looking at the face of the golf club head, as seen in FIG. 1. Secondly, the shaft axis (SA) is the axis of a bore in the golf club head that is designed to receive a shaft. Some golf club heads have an external hosel that contains a bore for receiving the shaft such that one skilled in the art can easily appreciate the shaft axis (SA), while other "hosel-less" golf clubs have an internal bore that receives the shaft that nonetheless defines the shaft axis (SA). The shaft axis (SA) is fixed by the design of the golf club head and is also illustrated in FIG. 1.

Now, the intersection of the shaft axis (SA) with the ground plane (GP) fixes an origin point, labeled "origin" in FIG. 1, for the coordinate system. While it is common knowledge in the industry, it is worth noting that the right side of the club head seen in FIG. 1, the side nearest the bore in which the shaft attaches, is the "heel" side of the golf club head; and the opposite side, the left side in FIG. 1, is referred to as the "toe" side of the golf club head. Additionally, the portion of the golf club head that actually strikes a golf ball is referred to as the face of the golf club head and is commonly referred to as the front of the golf club head; whereas the opposite end of the golf club head is referred to as the rear of the golf club head and/or the trailing edge.

A three dimensional coordinate system may now be established from the origin with the Y-direction being the vertical direction from the origin; the X-direction being the horizontal direction perpendicular to the Y-direction and wherein the X-direction is parallel to the face of the golf club head in the natural resting position, also known as the design position; and the Z-direction is perpendicular to the X-direction wherein the Z-direction is the direction toward the rear of the golf club head. The X, Y, and Z directions are noted on a coordinate system symbol in FIG. 1. It should be noted that this coordinate system is contrary to the traditional right-hand rule coordinate system; however it is preferred so that the center of gravity may be referred to as having all positive coordinates.

Figure 2:
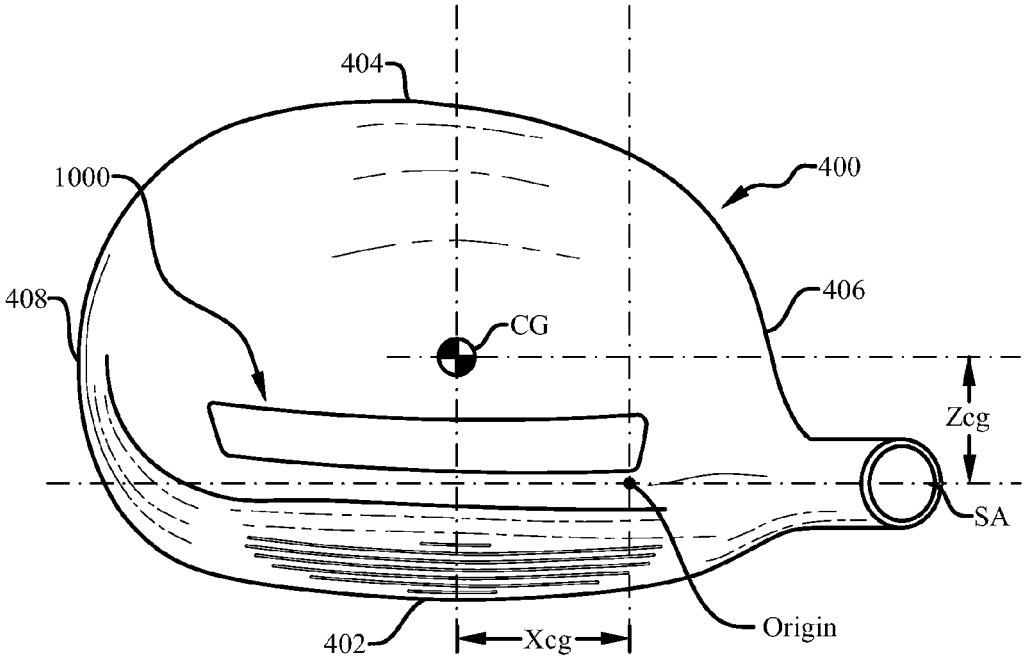
FIG. 2 shows a top plan view of an embodiment of the present invention, not to scale.
Figure 3:
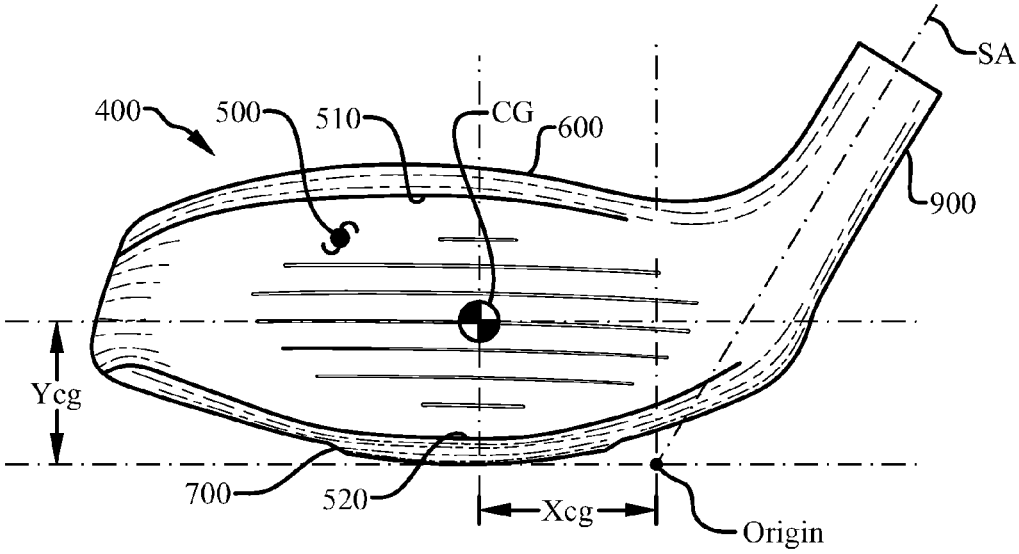
FIG. 3 shows a front elevation view of an embodiment of the present invention, not to scale.

Now, with the origin and coordinate system defined, the terms that define the location of the CG may be explained. One skilled in the art will appreciate that the CG of a hollow golf club head such as the wood-type golf club head illustrated in FIG. 2 will be behind the face of the golf club head. The distance behind the origin that the CG is located is referred to as Zcg, as seen in FIG. 2. Similarly, the distance above the origin that the CG is located is referred to as Ycg, as seen in FIG. 3. Lastly, the horizontal distance from the origin that the CG is located is referred to as Xcg, also seen in FIG. 3. Therefore, the location of the CG may be easily identified by reference to Xcg, Ycg, and Zcg.

Figure 4:
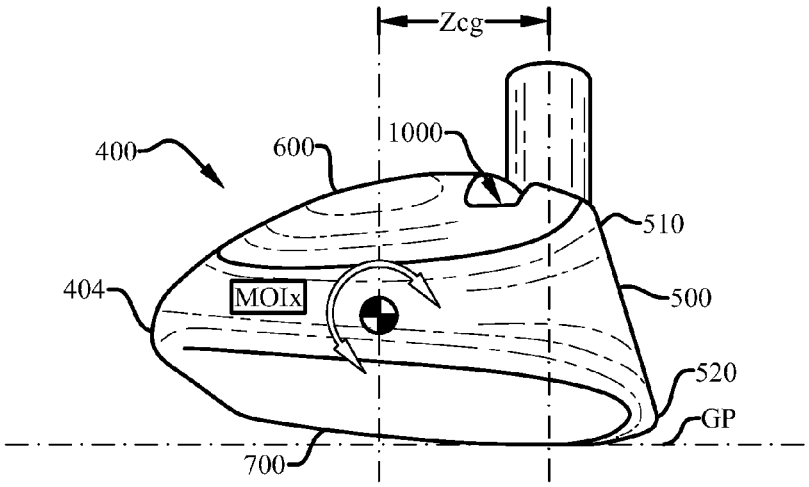
FIG. 4 shows a toe side elevation view of an embodiment of the present invention, not to scale.
Figure 5:
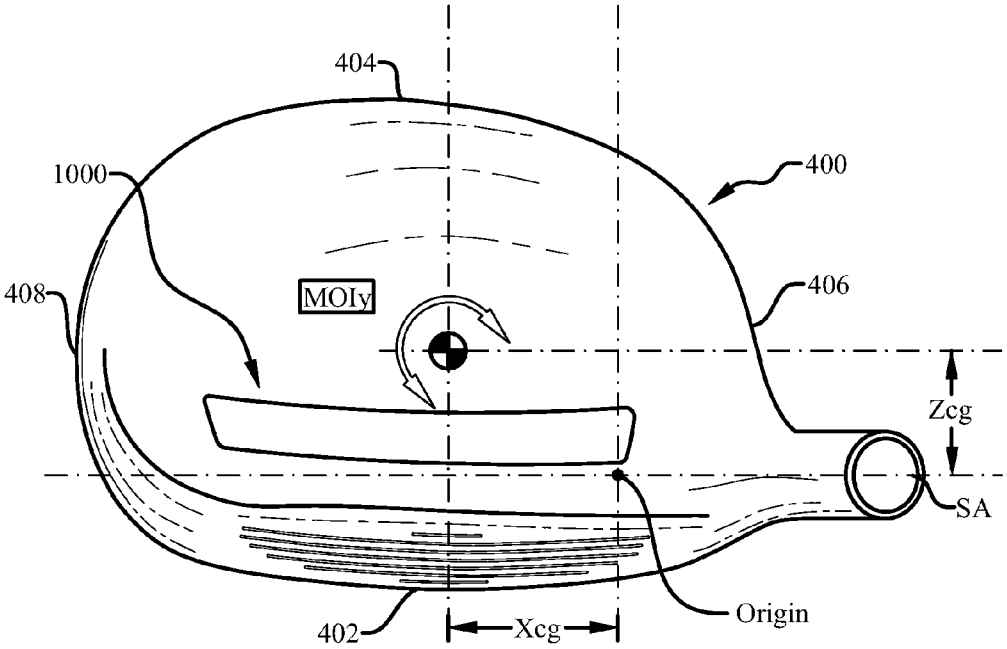
FIG. 5 shows a top plan view of an embodiment of the present invention, not to scale.

The moment of inertia of the golf club head is a key ingredient in the playability of the club. Again, one skilled in the art will understand what is meant by moment of inertia with respect to golf club heads; however it is helpful to define two moment of inertia components that will be commonly referred to herein. First, MOIx is the moment of inertia of the golf club head around an axis through the CG, parallel to the X-axis, labeled in FIG. 4. MOIx is the moment of inertia of the golf club head that resists lofting and delofting moments induced by ball strikes high or low on the face. Secondly, MOIy is the moment of the inertia of the golf club head around an axis through the CG, parallel to the Y-axis, labeled in FIG. 5. MOIy is the moment of inertia of the golf club head that resists opening and closing moments induced by ball strikes towards the toe side or heel side of the face.

Figure 6:
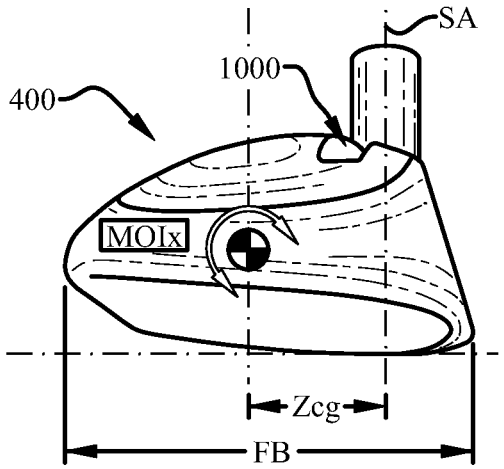
FIG. 6 shows a toe side elevation view of an embodiment of the present invention, not to scale.
Figure 7:
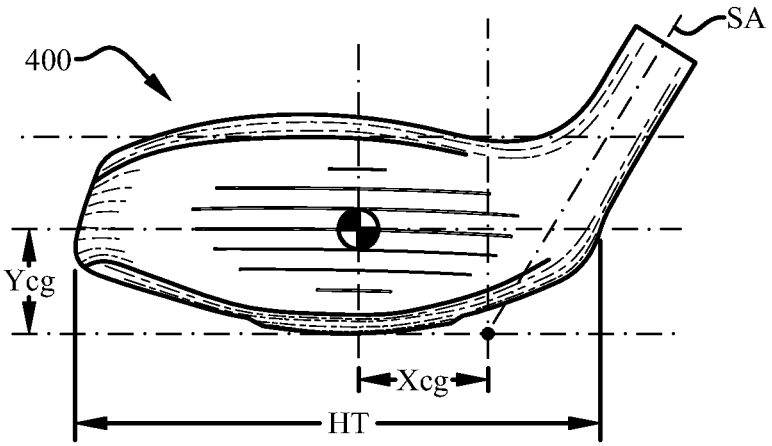
FIG. 7 shows a front elevation view of an embodiment of the present invention, not to scale.

Continuing with the definitions of key golf club head dimensions, the "front-to-back" dimension, referred to as the FB dimension, is the distance from the furthest forward point at the leading edge of the golf club head to the furthest rearward point at the rear of the golf club head, i.e. the trailing edge, as seen in FIG. 6. The "heel-to-toe" dimension, referred to as the HT dimension, is the distance from the point on the surface of the club head on the toe side that is furthest from the origin in the X-direction, to the point on the surface of the golf club head on the heel side that is 0.875" above the ground plane and furthest from the origin in the negative X-direction, as seen in FIG. 7.

Figure 9:
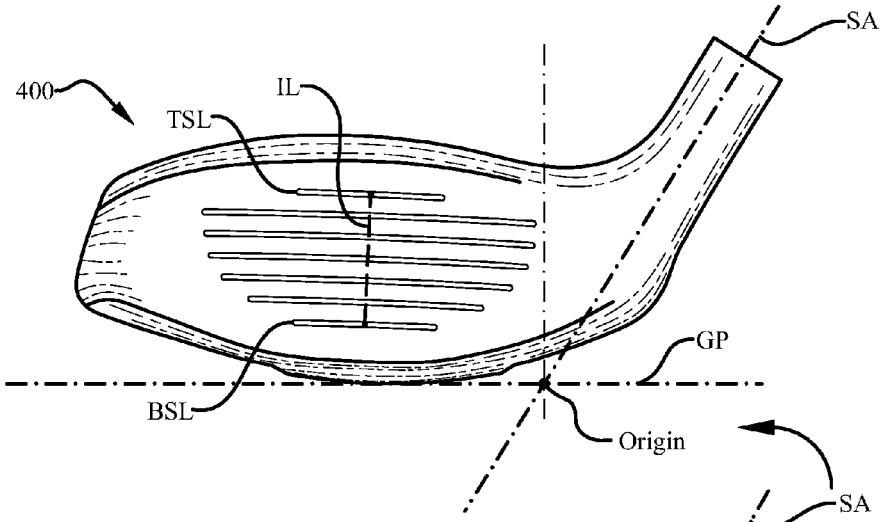
FIG. 9 shows a front elevation view of an embodiment of the present invention, not to scale.
Figure 10:
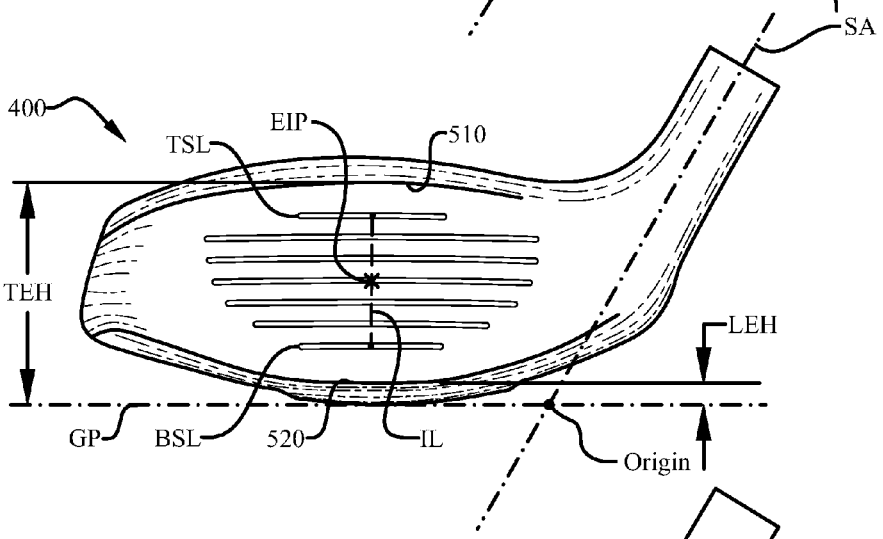
FIG. 10 shows a front elevation view of an embodiment of the present invention, not to scale.

A key location on the golf club face is an engineered impact point (EIP). The engineered impact point (EIP) is important in that it helps define several other key attributes of the present golf club head. The engineered impact point (EIP) is generally thought of as the point on the face that is the ideal point at which to strike the golf ball. Generally, the score lines on golf club heads enable one to easily identify the engineered impact point (EIP) for a golf club. In the embodiment of FIG. 9, the first step in identifying the engineered impact point (EIP) is to identify the top score line (TSL) and the bottom score line (BSL). Next, draw an imaginary line (IL) from the midpoint of the top score line (TSL) to the midpoint of the bottom score line (BSL). This imaginary line (IL) will often not be vertical since many score line designs are angled upward toward the toe when the club is in the natural position. Next, as seen in FIG. 10, the club must be rotated so that the top score line (TSL) and the bottom score line (BSL) are parallel with the ground plane (GP), which also means that the imaginary line (IL) will now be vertical. In this position, the leading edge height (LEH) and the top edge height (TEH) are measured from the ground plane (GP). Next, the face height is determined by subtracting the leading edge height (LEH) from the top edge height (TEH). The face height is then divided in half and added to the leading edge height (LEH) to yield the height of the engineered impact point (EIP). Continuing with the club head in the position of FIG. 10, a spot is marked on the imaginary line (IL) at the height above the ground plane (GP) that was just calculated. This spot is the engineered impact point (EIP).

Figure 11:
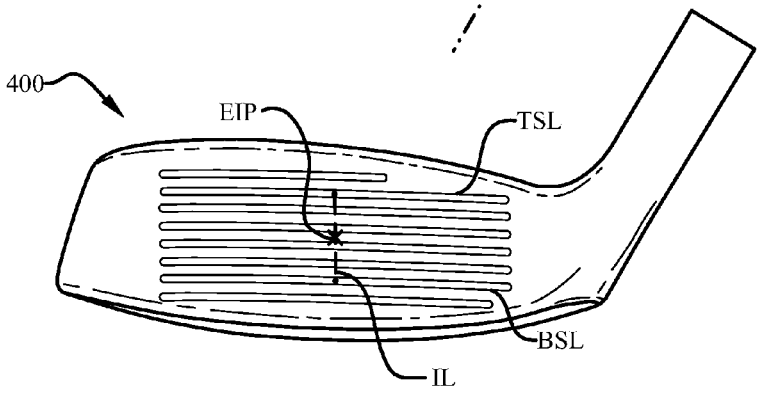
FIG. 11 shows a front elevation view of an embodiment of the present invention, not to scale.
Figure 12:
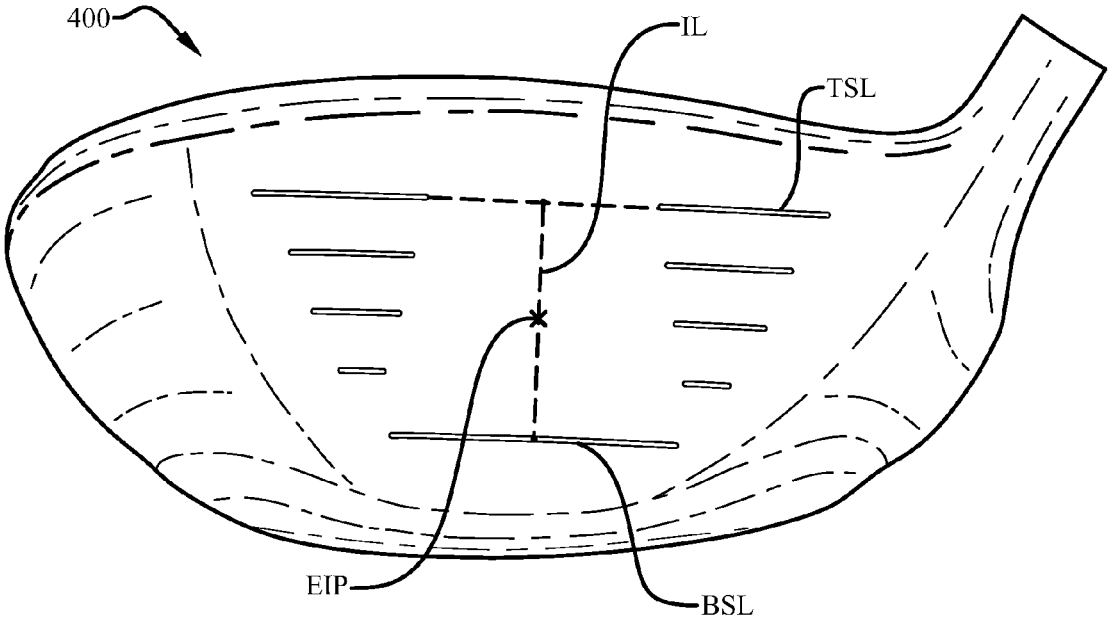
FIG. 12 shows a front elevation view of an embodiment of the present invention, not to scale.

The engineered impact point (EIP) may also be easily determined for club heads having alternative score line configurations. For instance, the golf club head of FIG. 11 does not have a centered top score line. In such a situation, the two outermost score lines that have lengths within 5% of one another are then used as the top score line (TSL) and the bottom score line (BSL). The process for determining the location of the engineered impact point (EIP) on the face is then determined as outlined above. Further, some golf club heads have non-continuous score lines, such as that seen at the top of the club head face in FIG. 12. In this case, a line is extended across the break between the two top score line sections to create a continuous top score line (TSL). The newly created continuous top score line (TSL) is then bisected and used to locate the imaginary line (IL). Again, then the process for determining the location of the engineered impact point (EIP) on the face is determined as outlined above.

The engineered impact point (EIP) may also be easily determined in the rare case of a golf club head having an asymmetric score line pattern, or no score lines at all. In such embodiments the engineered impact point (EIP) shall be determined in accordance with the USGA "Procedure for Measuring the Flexibility of a Golf Clubhead," Revision 2.0, Mar. 25, 2005, which is incorporated herein by reference. This USGA procedure identifies a process for determining the impact location on the face of a golf club that is to be tested, also referred therein as the face center. The USGA procedure utilizes a template that is placed on the face of the golf club to determine the face center. In these limited cases of asymmetric score line patterns, or no score lines at all, this USGA face center shall be the engineered impact point (EIP) that is referenced throughout this application.

Figure 22:
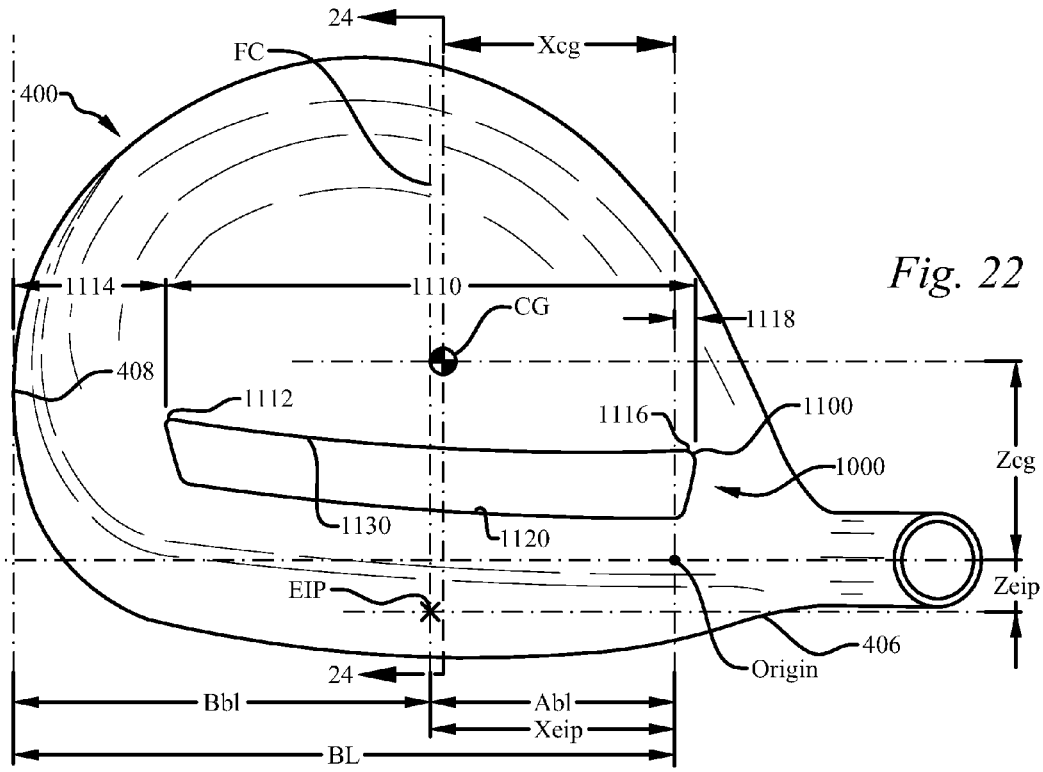
FIG. 22 shows a top plan view of an embodiment of the present invention, not to scale.
Figure 23:
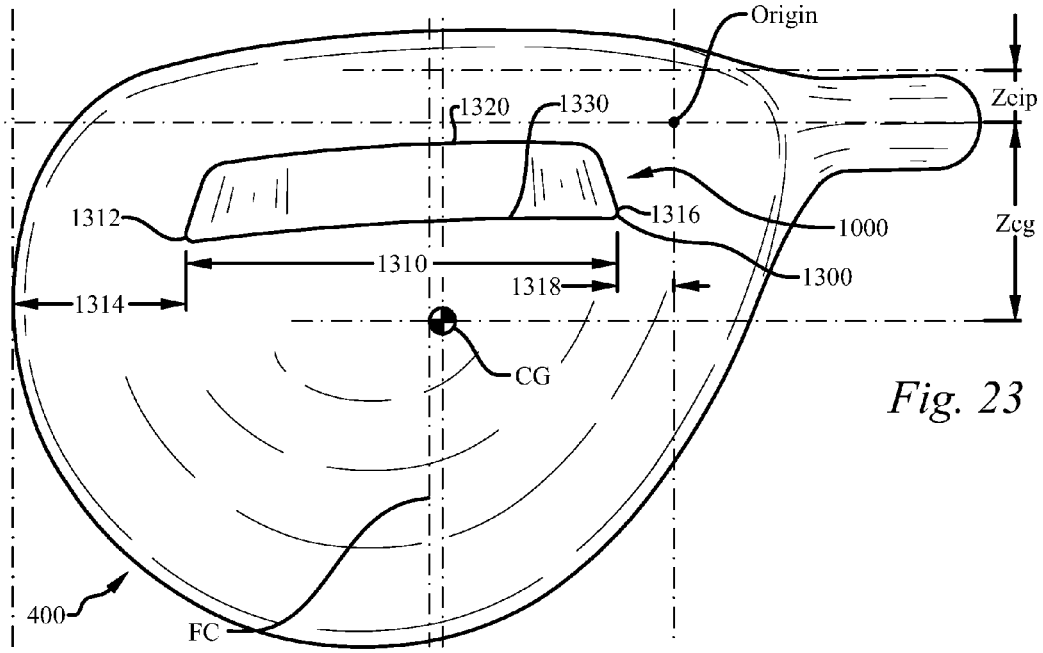
FIG. 23 shows a bottom plan view of an embodiment of the present invention, not to scale.
Figure 24:
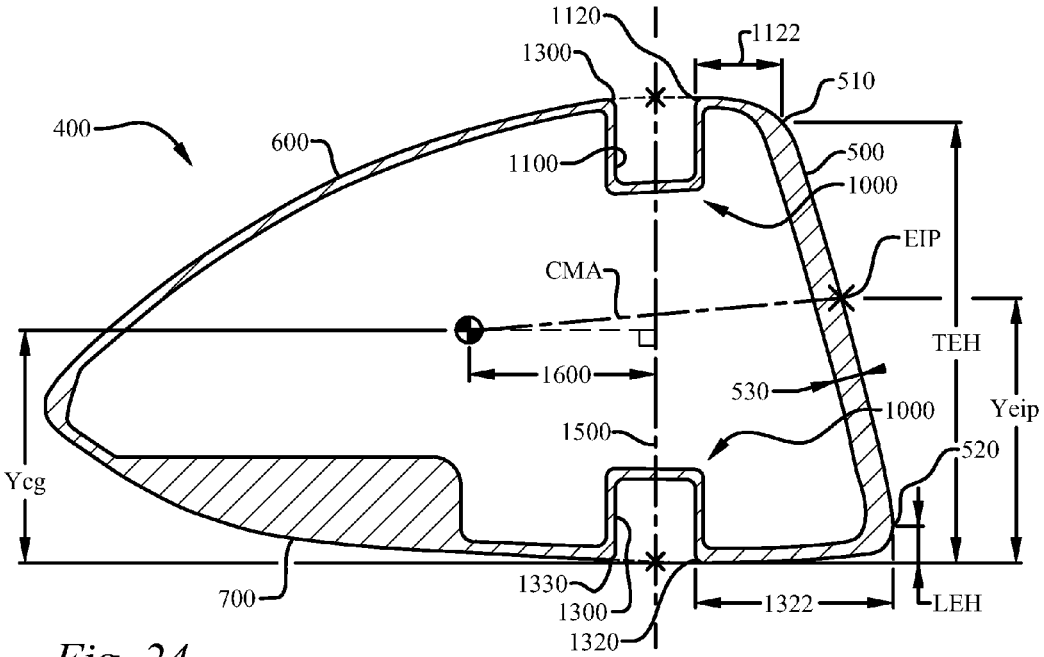
FIG. 24 shows a partial cross-sectional view of an embodiment of the present invention, not to scale.

The engineered impact point (EIP) on the face is an important reference to define other attributes of the present golf club head. The engineered impact point (EIP) is generally shown on the face with rotated crosshairs labeled EIP. The precise location of the engineered impact point (EIP) can be identified via the dimensions Xeip, Yeip, and Zeip, as illustrated in FIGS. 22-24. The X coordinate Xeip is measured in the same manner as Xcg, the Y coordinate Yeip is measured in the same manner as Ycg, and the Z coordinate Zeip is measured in the same manner as Zcg, except that Zeip is always a positive value regardless of whether it is in front of the origin point or behind the origin point.

Figure 8:
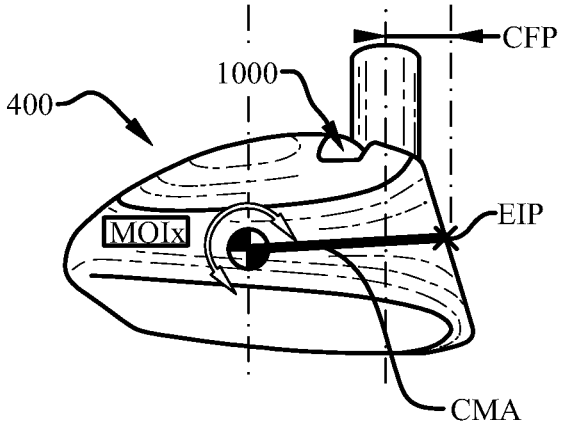
FIG. 8 shows a toe side elevation view of an embodiment of the present invention, not to scale.
Figure 14:
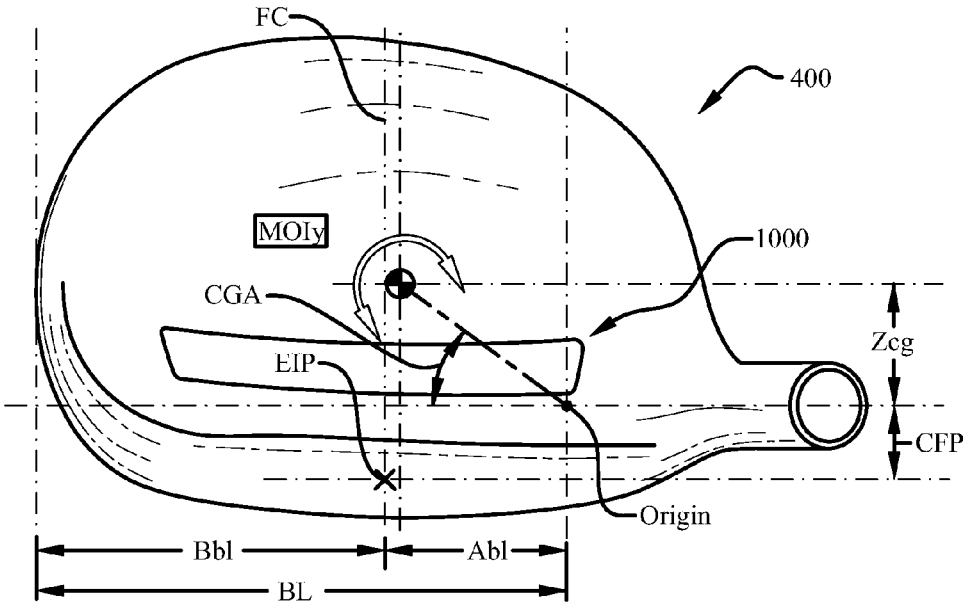
FIG. 14 shows a top plan view of an embodiment of the present invention, not to scale.
Figure 15:
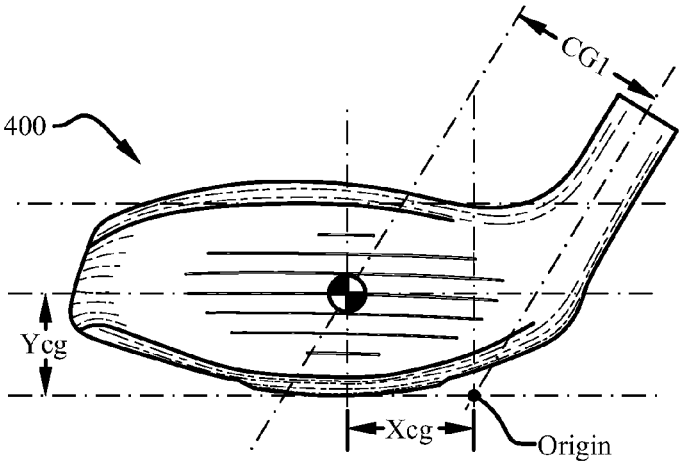
FIG. 15 shows a front elevation view of an embodiment of the present invention, not to scale.
Figure 16:
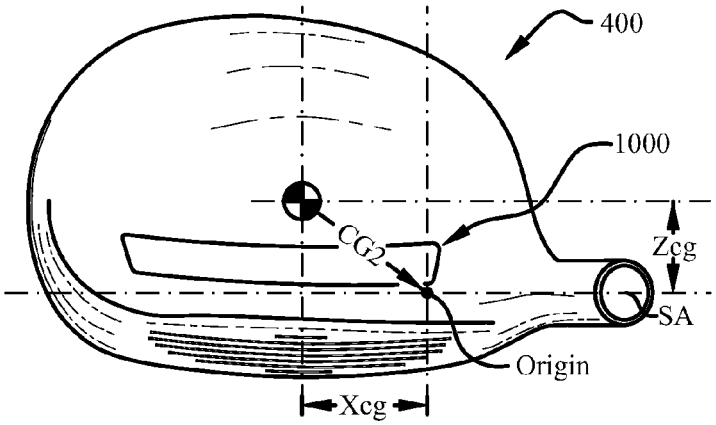
FIG. 16 shows a top plan view of an embodiment of the present invention, not to scale.

One important dimension that utilizes the engineered impact point (EIP) is the center face progression (CFP), seen in FIGS. 8 and 14. The center face progression (CFP) is a single dimension measurement and is defined as the distance in the Z-direction from the shaft axis (SA) to the engineered impact point (EIP). A second dimension that utilizes the engineered impact point (EIP) is referred to as a club moment arm (CMA). The CMA is the two dimensional distance from the CG of the club head to the engineered impact point (EIP) on the face, as seen in FIG. 8. Thus, with reference to the coordinate system shown in FIG. 1, the club moment arm (CMA) includes a component in the Z-direction and a component in the Y-direction, but ignores any difference in the X-direction between the CG and the engineered impact point (EIP). Thus, the club moment arm (CMA) can be thought of in terms of an impact vertical plane passing through the engineered impact point (EIP) and extending in the Z-direction. First, one would translate the CG horizontally in the X-direction until it hits the impact vertical plane. Then, the club moment arm (CMA) would be the distance from the projection of the CG on the impact vertical plane to the engineered impact point (EIP). The club moment arm (CMA) has a significant impact on the launch angle and the spin of the golf ball upon impact.

Figure 13:
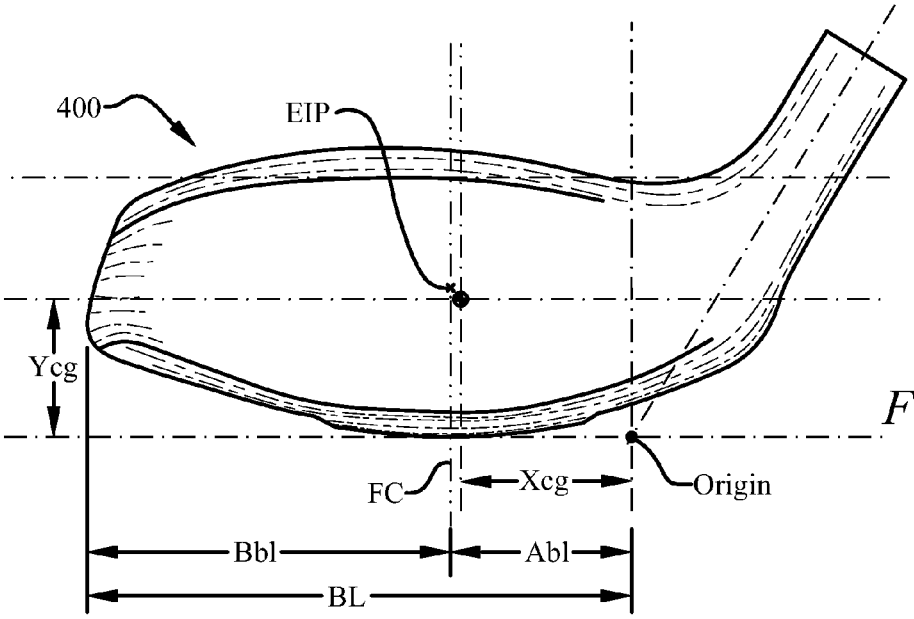
FIG. 13 shows a front elevation view of an embodiment of the present invention, not to scale.

Another important dimension in golf club design is the club head blade length (BL), seen in FIG. 13 and FIG. 14. The blade length (BL) is the distance from the origin to a point on the surface of the club head on the toe side that is furthest from the origin in the X-direction. The blade length (BL) is composed of two sections, namely the heel blade length section (Abl) and the toe blade length section (Bbl). The point of delineation between these two sections is the engineered impact point (EIP), or more appropriately, a vertical line, referred to as a face centerline (FC), extending through the engineered impact point (EIP), as seen in FIG. 13, when the golf club head is in the normal resting position, also referred to as the design position.

Further, several additional dimensions are helpful in understanding the location of the CG with respect to other points that are essential in golf club engineering. First, a CG angle (CGA) is the one dimensional angle between a line connecting the CG to the origin and an extension of the shaft axis (SA), as seen in FIG. 14. The CG angle (CGA) is measured solely in the X-Z plane and therefore does not account for the elevation change between the CG and the origin, which is why it is easiest understood in reference to the top plan view of FIG. 14.

Figure 17:
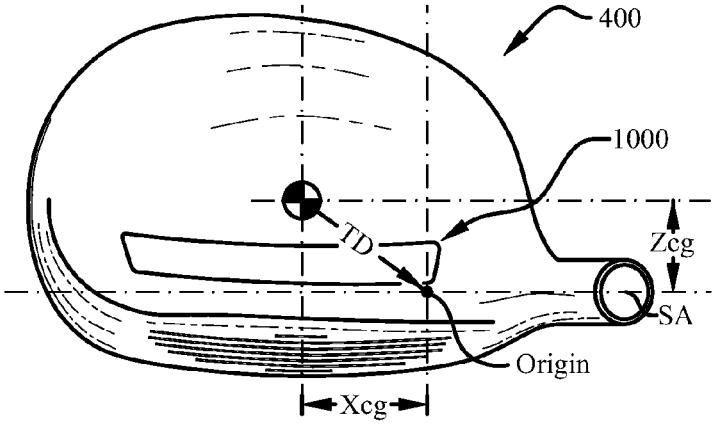
FIG. 17 shows a top plan view of an embodiment of the present invention, not to scale.
Figure 18:
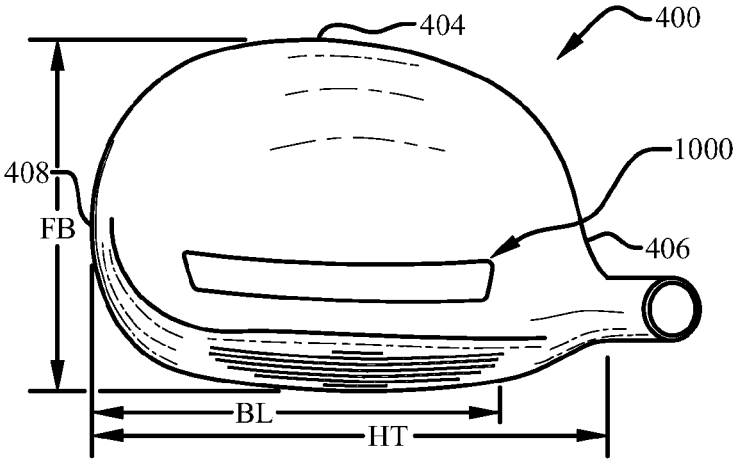
FIG. 18 shows a top plan view of an embodiment of the present invention, not to scale.
Figure 19:
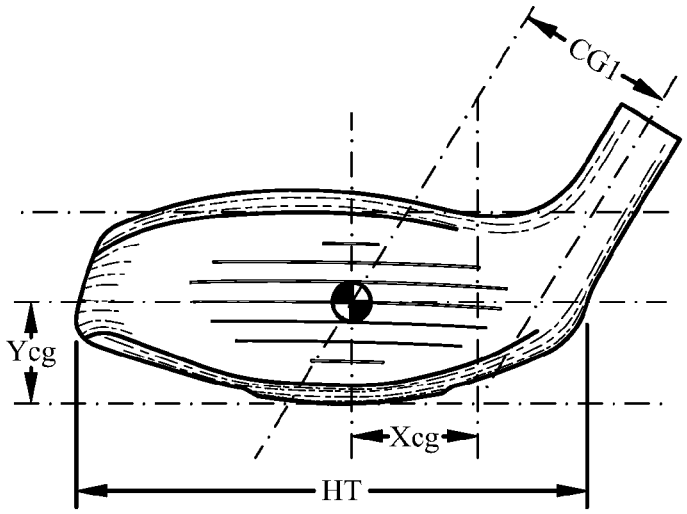
FIG. 19 shows a front elevation view of an embodiment of the present invention, not to scale.
Figure 20:
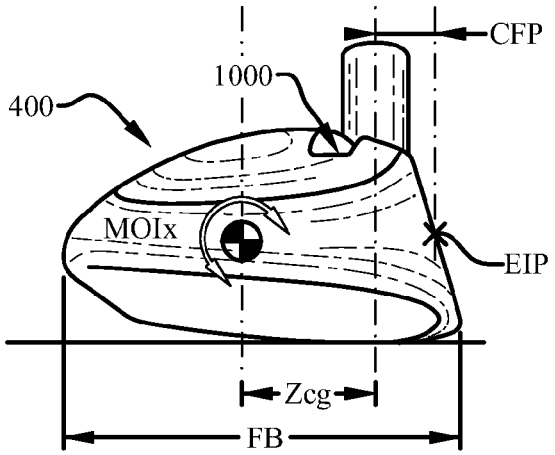
FIG. 20 shows a toe side elevation view of an embodiment of the present invention, not to scale.

Lastly, another important dimension in quantifying the present golf club only takes into consideration two dimensions and is referred to as the transfer distance (TD), seen in FIG. 17. The transfer distance (TD) is the horizontal distance from the CG to a vertical line extending from the origin; thus, the transfer distance (TD) ignores the height of the CG, or Ycg. Thus, using the Pythagorean Theorem from simple geometry, the transfer distance (TD) is the hypotenuse of a right triangle with a first leg being Xcg and the second leg being Zcg.

The transfer distance (TD) is significant in that is helps define another moment of inertia value that is significant to the present golf club. This new moment of inertia value is defined as the face closing moment of inertia, referred to as MOIfc, which is the horizontally translated (no change in Y-direction elevation) version of MOIy around a vertical axis that passes through the origin. MOIfc is calculated by adding MOIy to the product of the club head mass and the transfer distance (TD) squared. Thus, $$MOIfc=MOIy+(mass*(TD)^2)$$

The face closing moment (MOIfc) is important because is represents the resistance that a golfer feels during a swing when trying to bring the club face back to a square position for impact with the golf ball. In other words, as the golf swing returns the golf club head to its original position to impact the golf ball the face begins closing with the goal of being square at impact with the golf ball.

Figure 21:
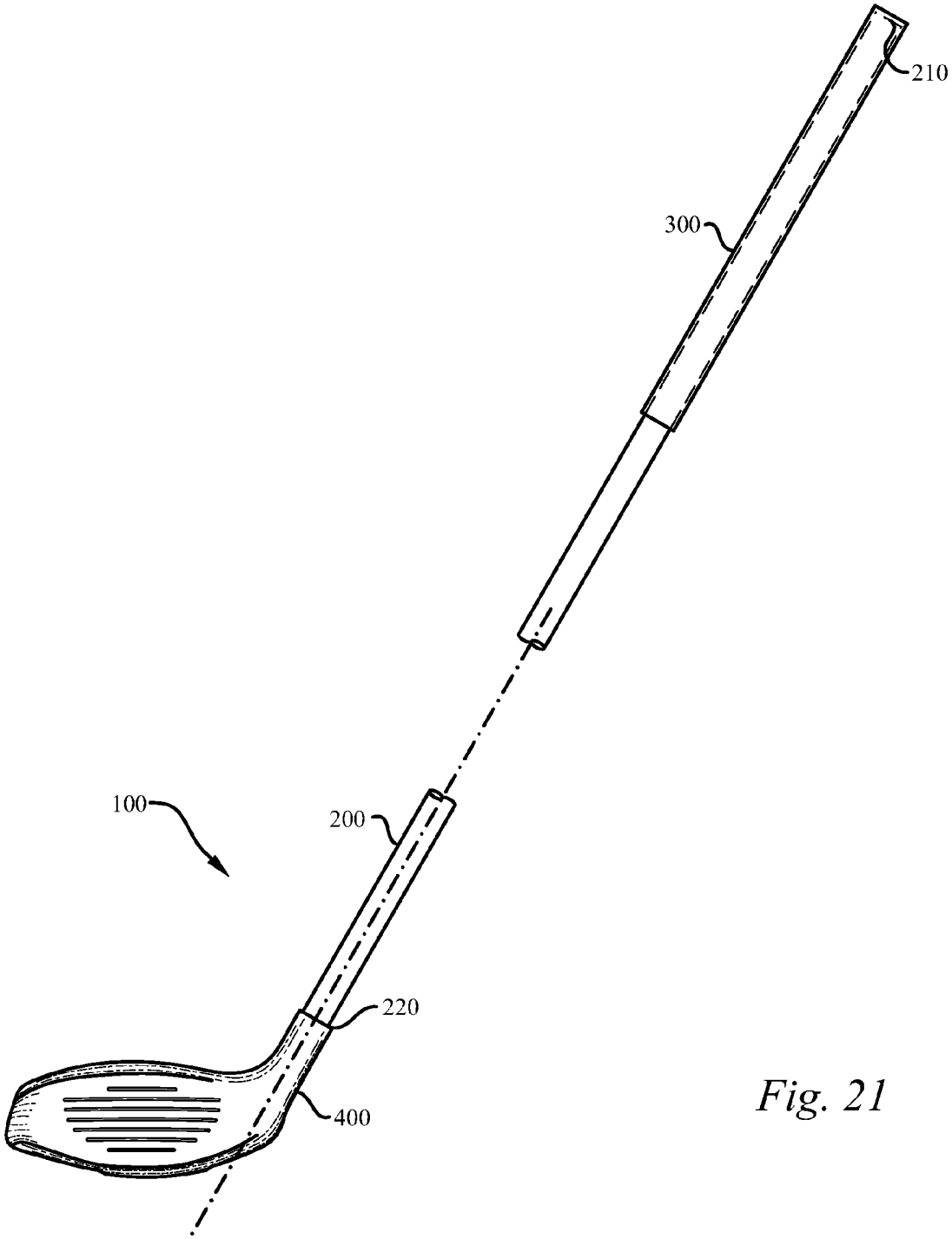
FIG. 21 shows a front elevation view of an embodiment of the present invention, not to scale.

The presently disclosed hollow golf club incorporates stress reducing features unlike prior hollow type golf clubs. The hollow type golf club includes a shaft (200) having a proximal end (210) and a distal end (220); a grip (300) attached to the shaft proximal end (210); and a golf club head (100) attached at the shaft distal end (220), as seen in FIG. 21. The overall hollow type golf club has a club length of at least 36 inches and no more than 45 inches, as measure in accordance with USGA guidelines.

The golf club head (400) itself is a hollow structure that includes a face (500) positioned at a front portion (402) of the golf club head (400) where the golf club head (400) impacts a golf ball, a sole (700) positioned at a bottom portion of the golf club head (400), a crown (600) positioned at a top portion of the golf club head (400), and a skirt (800) positioned around a portion of a periphery of the golf club head (400) between the sole (700) and the crown (800). The face (500), sole (700), crown (600), and skirt (800) define an outer shell that further defines a head volume that is less than 300 cubic centimeters for the golf club head (400). Additionally, the golf club head (400) has a rear portion (404) opposite the face (500). The rear portion (404) includes the trailing edge of the golf club head (400), as is understood by one with skill in the art. The face (500) has a loft (L) of at least 12 degrees and no more than 30 degrees, and the face (500) includes an engineered impact point (EIP) as defined above. One skilled in the art will appreciate that the skirt (800) may be significant at some areas of the golf club head (400) and virtually nonexistent at other areas; particularly at the rear portion (404) of the golf club head (400) where it is not uncommon for it to appear that the crown (600) simply wraps around and becomes the sole (700).

The golf club head (100) includes a bore having a center that defines a shaft axis (SA) that intersects with a horizontal ground plane (GP) to define an origin point, as previously explained. The bore is located at a heel side (406) of the golf club head (400) and receives the shaft distal end (220) for attachment to the golf club head (400). The golf club head (100) also has a toe side (408) located opposite of the heel side (406). The presently disclosed golf club head (400) has a club head mass of less than 270 grams, which combined with the previously disclosed loft, club head volume, and club length establish that the presently disclosed golf club is directed to a hollow golf club such as a fairway wood, hybrid, or hollow iron.

Figure 25:
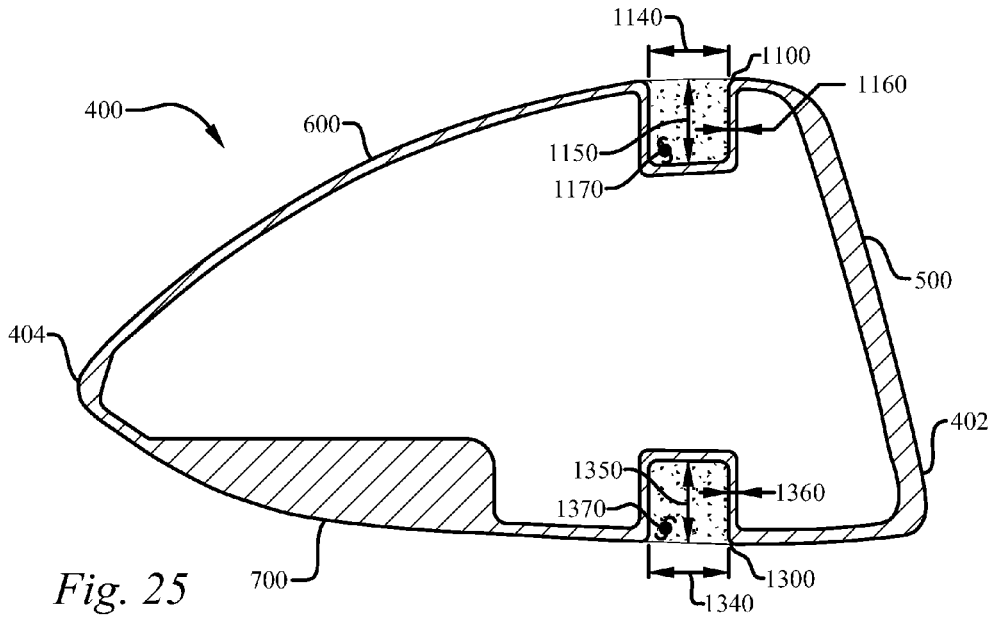
FIG. 25 shows a partial cross-sectional view of an embodiment of the present invention, not to scale.

The golf club head (400) includes a stress reducing feature (1000) including a crown located SRF (1100) located on the crown (600), seen in FIG. 22, and a sole located SRF (1300) located on the sole (700), seen in FIG. 23. As seen in FIGS. 22 and 25, the crown located SRF (1100) has a CSRF length (1110) between a CSRF toe-most point (1112) and a CSRF heel-most point (1116), a CSRF leading edge (1120), a CSRF trailing edge (1130), a CSRF width (1140), and a CSRF depth (1150). Similarly, as seen in FIGS. 23 and 25, the sole located SRF (1300) has a SSRF length (1310) between a SSRF toe-most point (1312) and a SSRF heel-most point (1316), a SSRF leading edge (1320), a SSRF trailing edge (1330), a SSRF width (1340), and a SSRF depth (1350).

With reference now to FIG. 24, a SRF connection plane (1500) passes through a portion of the crown located SRF (1100) and the sole located SRF (1300). To locate the SRF connection plane (1500) a vertical section is taken through the club head (400) in a front-to-rear direction, perpendicular to a vertical plane created by the shaft axis (SA); such a section is seen in FIG. 24. Then a crown SRF midpoint of the crown located SRF (1100) is determined at a location on a crown imaginary line following the natural curvature of the crown (600). The crown imaginary line is illustrated in FIG. 24 with a broken, or hidden, line connecting the CSRF leading edge (1120) to the CSRF trailing edge (1130), and the crown SRF midpoint is illustrated with an X. Similarly, a sole SRF midpoint of the sole located SRF (1300) is determined at a location on a sole imaginary line following the natural curvature of the sole (700). The sole imaginary line is illustrated in FIG. 24 with a broken, or hidden, line connecting the SSRF leading edge (1320) to the SSRF trailing edge (1330), and the sole SRF midpoint is illustrated with an X. Finally, the SRF connection plane (1500) is a plane in the heel-to-toe direction that passes through both the crown SRF midpoint and the sole SRF midpoint, as seen in FIG. 24. While the SRF connection plane (1500) illustrated in FIG. 24 is approximately vertical, the orientation of the SRF connection plane (1500) depends on the locations of the crown located SRF (1100) and the sole located SRF (1300) and may be angled toward the face, as seen in FIG. 26, or angled away from the face, as seen in FIG. 27.

Figure 26:
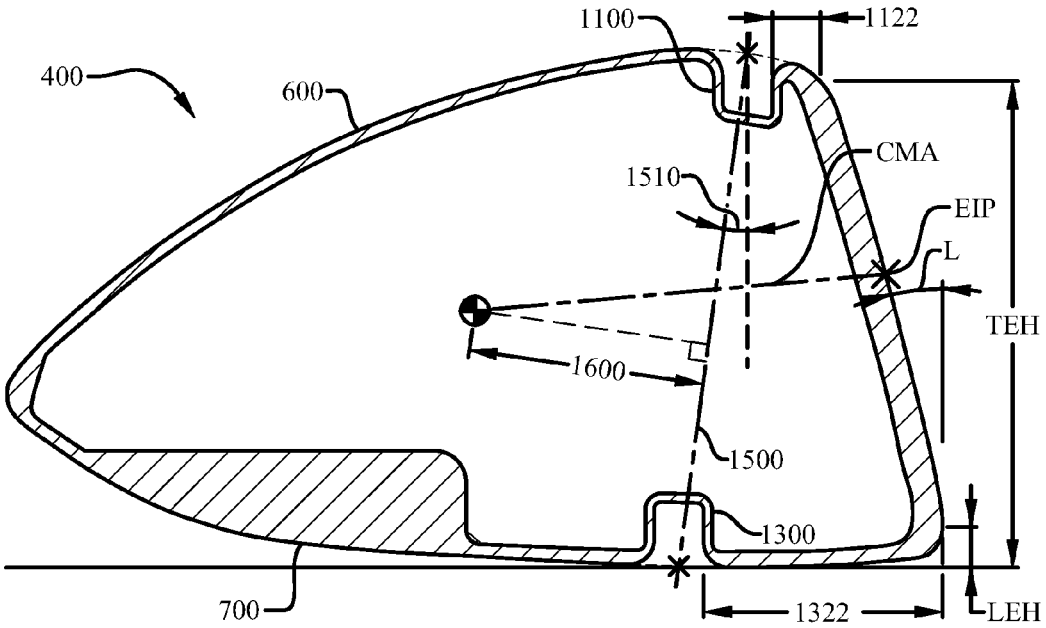
FIG. 26 shows a partial cross-sectional view of an embodiment of the present invention, not to scale.
Figure 27:
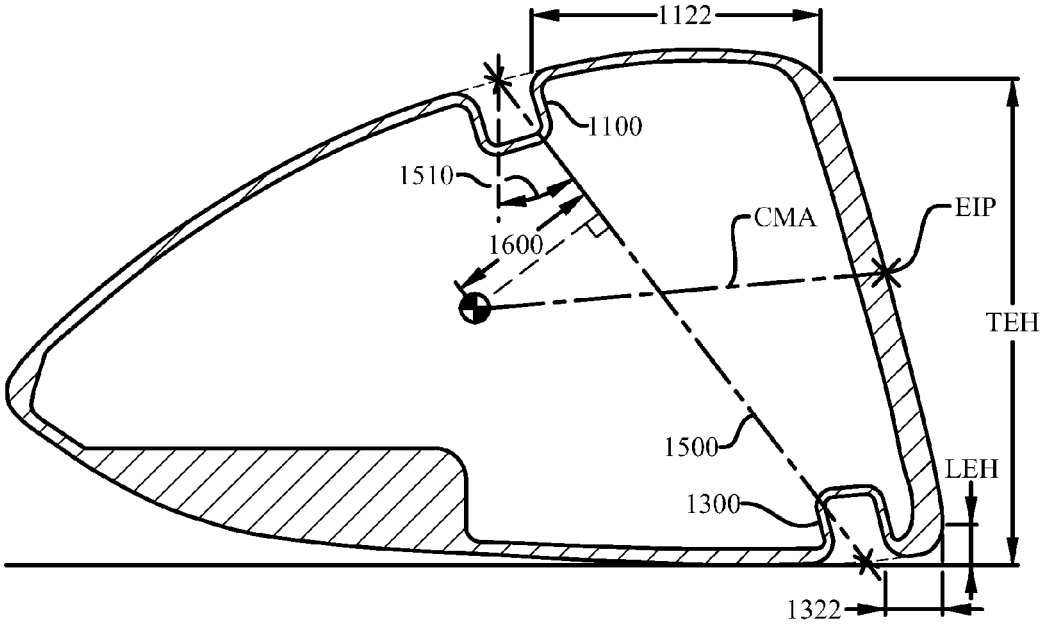
FIG. 27 shows a partial cross-sectional view of an embodiment of the present invention, not to scale.

The SRF connection plane (1500) is oriented at a connection plane angle (1510) from the vertical, seen in FIGS. 26 and 27, which aids in defining the location of the crown located SRF (1100) and the sole located SRF (1300). In one particular embodiment the crown located SRF (1100) and the sole located SRF (1300) are not located vertically directly above and below one another; rather, the connection plane angle (1510) is greater than zero and less than ninety percent of a loft (L) of the club head (400), as seen in FIG. 26. The sole located SRF (1300) could likewise be located in front of, i.e. toward the face (500), the crown located SRF (1100) and still satisfy the criteria of this embodiment; namely, that the connection plane angle (1510) is greater than zero and less than ninety percent of a loft of the club head (400).

In an alternative embodiment, seen in FIG. 27, the SRF connection plane (1500) is oriented at a connection plane angle (1510) from the vertical and the connection plane angle (1510) is at least ten percent greater than a loft (L) of the club head (400). The crown located SRF (1100) could likewise be located in front of, i.e. toward the face (500), the sole located SRF (1300) and still satisfy the criteria of this embodiment; namely, that the connection plane angle (1510) is at least ten percent greater than a loft (L) of the club head (400). In an even further embodiment the SRF connection plane (1500) is oriented at a connection plane angle (1510) from the vertical and the connection plane angle (1510) is at least fifty percent greater than a loft (L) of the club head (400), but less than one hundred percent greater than the loft (L). These three embodiments recognize a unique relationship between the crown located SRF (1100) and the sole located SRF (1300) such that they are not vertically aligned with one another, while also not merely offset in a manner matching the loft (L) of the club head (400).

Figure 30:
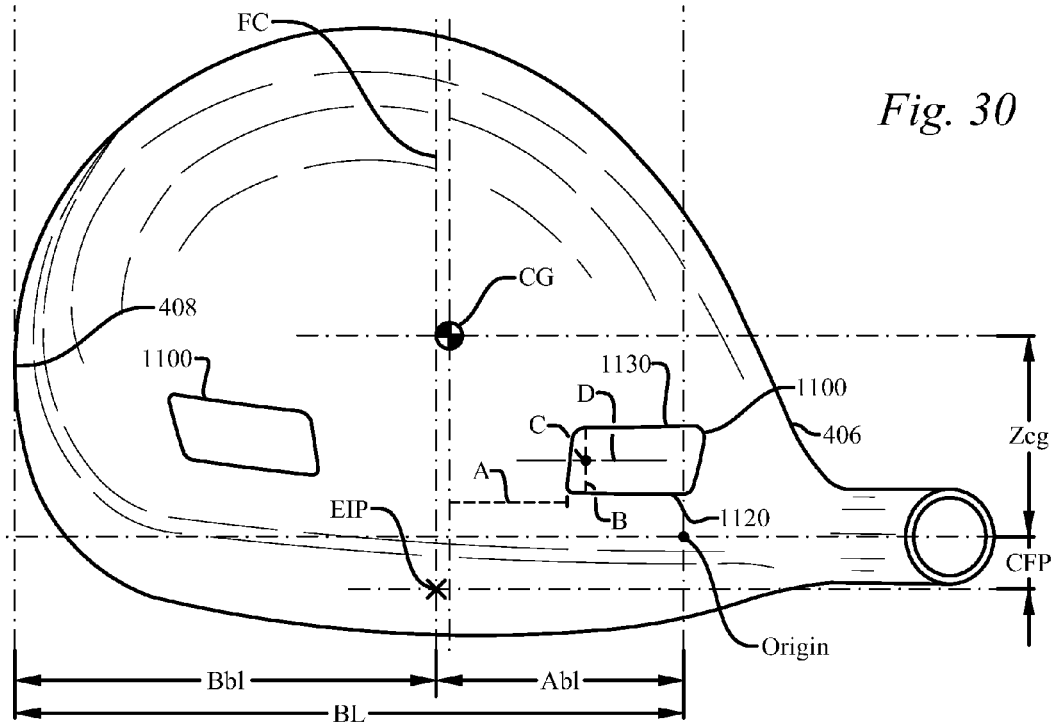
FIG. 30 shows a top plan view of an embodiment of the present invention, not to scale.
Figure 31:
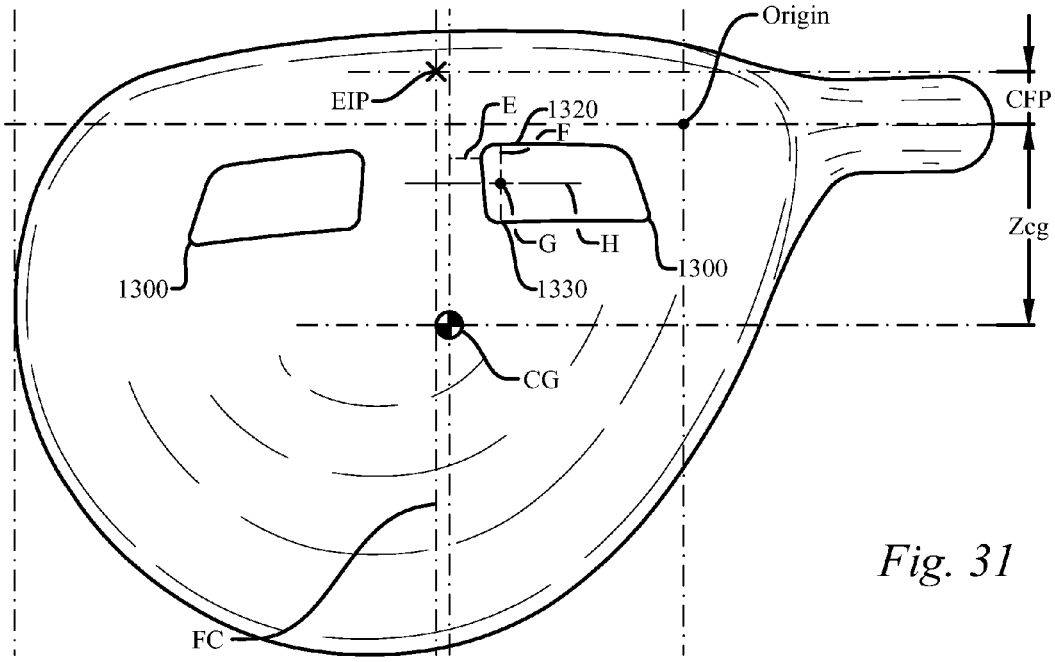
FIG. 31 shows a bottom plan view of an embodiment of the present invention, not to scale.
Figure 32:
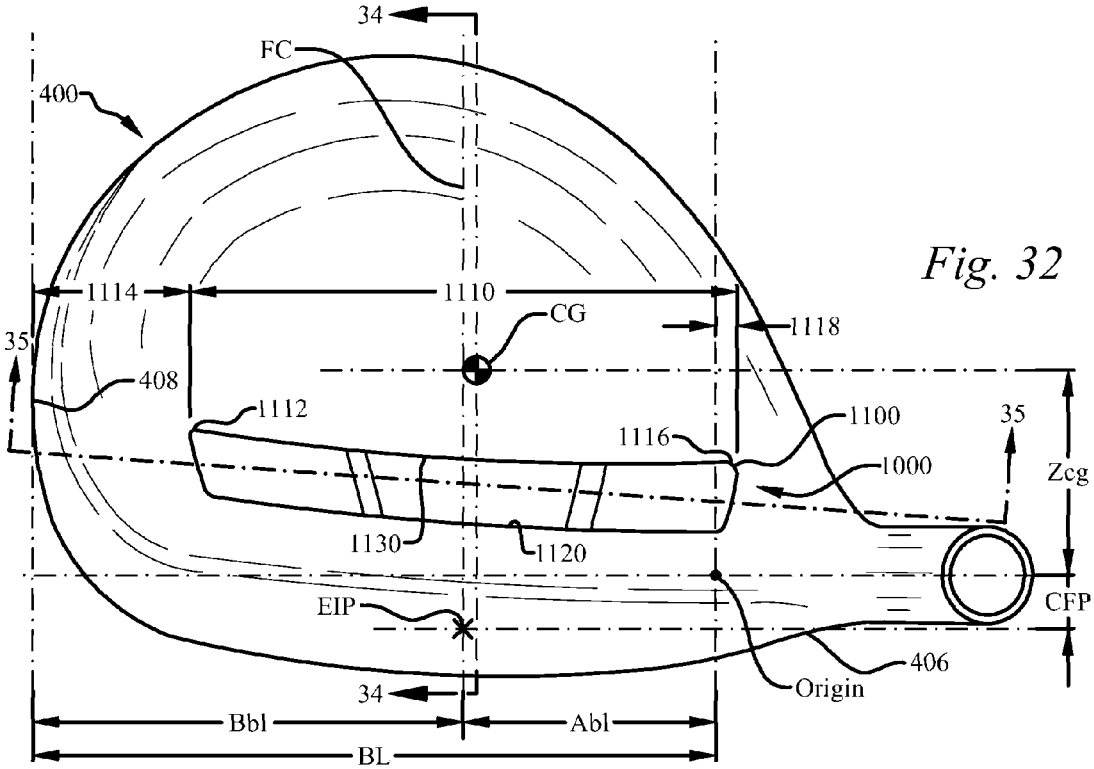
FIG. 32 shows a top plan view of an embodiment of the present invention, not to scale.
Figure 33:
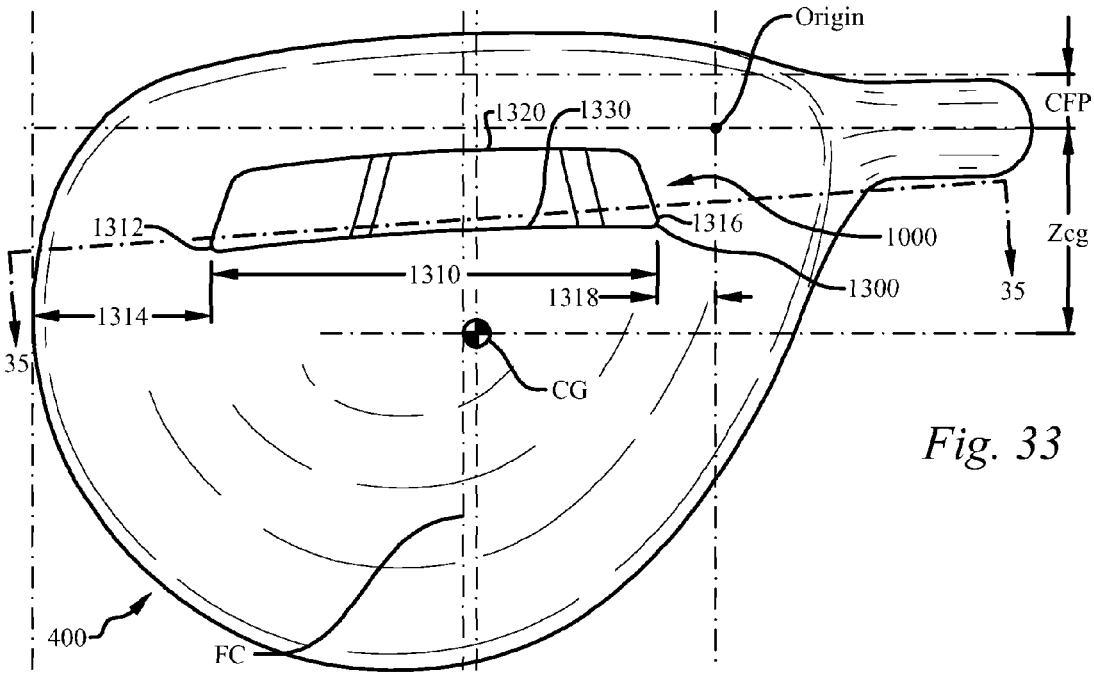
FIG. 33 shows a bottom plan view of an embodiment of the present invention, not to scale.
Figure 34:
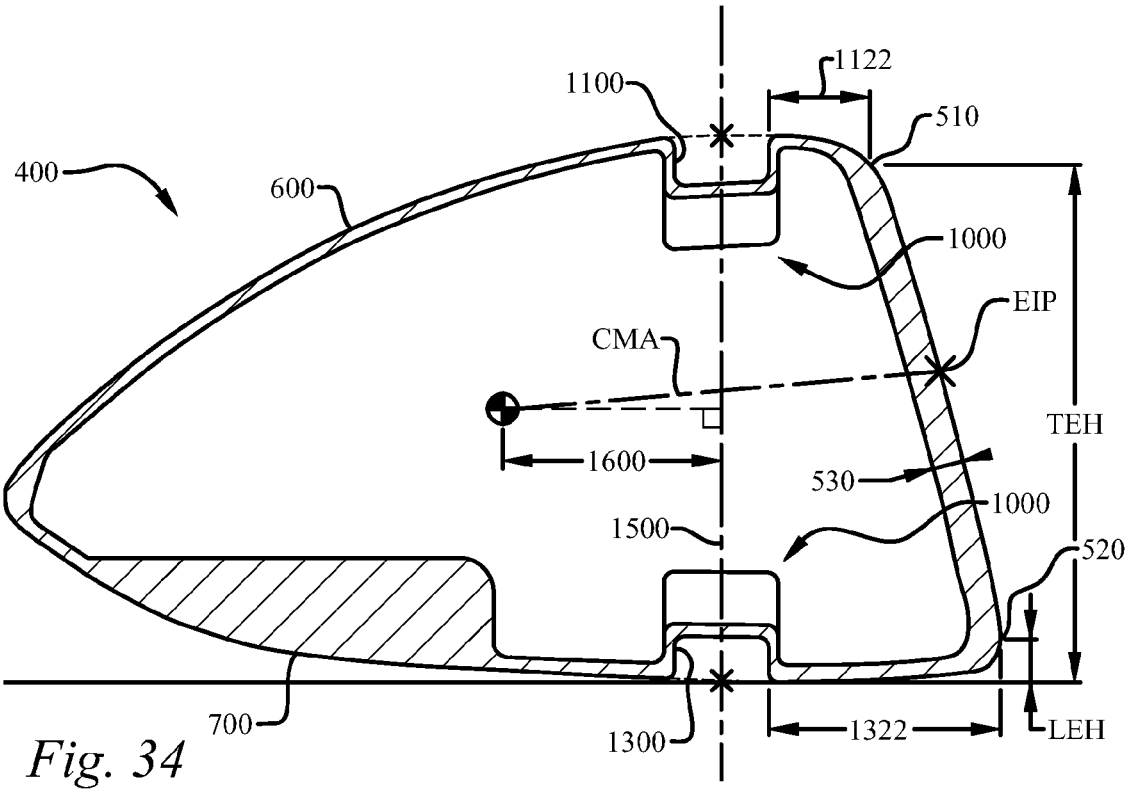
FIG. 34 shows a partial cross-sectional view of an embodiment of the present invention, not to scale.

With reference now to FIGS. 30 and 31, in the event that a crown located SRF (1100) or a sole located SRF (1300), or both, do not exist at the location of the CG section, labeled as section 24-24 in FIG. 22, then the crown located SRF (1100) located closest to the front-to-rear vertical plane passing through the CG is selected. For example, as seen in FIG. 30 the right crown located SRF (1100) is nearer to the front-to-rear vertical CG plane than the left crown located SRF (1100). In other words the illustrated distance "A" is smaller for the right crown located SRF (1100). Next, the face centerline (FC) is translated until it passes through both the CSRF leading edge (1120) and the CSRF trailing edge (1130), as illustrated by broken line "B". Then, the midpoint of line "B" is found and labeled "C". Finally, imaginary line "D" is created that is perpendicular to the "B" line.

The same process is repeated for the sole located SRF (1300), as seen in FIG. 31. It is simply a coincidence that both the crown located SRF (1100) and the sole located SRF (1300) located closest to the front-to-rear vertical CG plane are both on the heel side (406) of the golf club head (400). The same process applies even when the crown located SRF (1100) and the sole located SRF (1300) located closest to the front-to-rear vertical CG plane are on opposites sides of the golf club head (400). Now, still referring to FIG. 31, the process first involves identifying that the right sole located SRF (1300) is nearer to the front-to-rear vertical CG plane than the left sole located SRF (1300). In other words the illustrated distance "E" is smaller for the heel-side sole located SRF (1300). Next, the face centerline (FC) is translated until it passes through both the SSRF leading edge (1320) and the SSRF trailing edge (1330), as illustrated by broken line "F". Then, the midpoint of line "F" is found and labeled "G". Finally, imaginary line "H" is created that is perpendicular to the "F" line. The plane passing through both the imaginary line "D" and imaginary line "H" is the SRF connection plane (1500).

Next, referring back to FIG. 24, a CG-to-plane offset (1600) is defined as the shortest distance from the center of gravity (CG) to the SRF connection plane (1500), regardless of the location of the CG. In one particular embodiment the CG-to-plane offset (1600) is at least twenty-five percent less than the club moment arm (CMA) and the club moment arm (CMA) is less than 1.3 inches. The locations of the crown located SRF (1100) and the sole located SRF (1300) described herein, and the associated variables identifying the location, are selected to preferably reduce the stress in the face (500) when impacting a golf ball while accommodating temporary flexing and deformation of the crown located SRF (1100) and sole located SRF (1300) in a stable manner in relation to the CG location, and/or origin point, while maintaining the durability of the face (500), the crown (600), and the sole (700). Experimentation and modeling has shown that both the crown located SRF (1100) and the sole located SRF (1300) are necessary to increase the deflection of the face (500), while also reduce the peak stress on the face (500) at impact with a golf ball. This reduction in stress allows a substantially thinner face to be utilized, permitting the weight savings to be distributed elsewhere in the club head (400). Further, the increased deflection of the face (500) facilitates improvements in the coefficient of restitution (COR) of the club head (400), particularly for club heads having a volume of 300 cc or less.

In fact, further embodiments even more precisely identify the location of the crown located SRF (1100) and the sole located SRF (1300) to achieve these objectives. For instance, in one further embodiment the CG-to-plane offset (1600) is at least twenty-five percent of the club moment arm (CMA) and less than seventy-five percent of the club moment arm (CMA). In still a further embodiment, the CG-to-plane offset (1600) is at least forty percent of the club moment arm (CMA) and less than sixty percent of the club moment arm (CMA).

Alternatively, another embodiment relates the location of the crown located SRF (1100) and the sole located SRF (1300) to the difference between the maximum top edge height (TEH) and the minimum lower edge (LEH), referred to as the face height, rather than utilizing the CG-to-plane offset (1600) variable as previously discussed. As such, two additional variables are illustrated in FIG. 24, namely the CSRF leading edge offset (1122) and the SSRF leading edge offset (1322). The CSRF leading edge offset (1122) is the distance from any point along the CSRF leading edge (1120) directly forward, in the Zcg direction, to the point at the top edge (510) of the face (500). Thus, the CSRF leading edge offset (1122) may vary along the length of the CSRF leading edge (1120), or it may be constant if the curvature of the CSRF leading edge (1120) matches the curvature of the top edge (510) of the face (500). Nonetheless, there will always be a minimum CSRF leading edge offset (1122) at the point along the CSRF leading edge (1120) that is the closest to the corresponding point directly in front of it on the face top edge (510), and there will be a maximum CSRF leading edge offset (1122) at the point along the CSRF leading edge (1120) that is the farthest from the corresponding point directly in front of it on the face top edge (510). Likewise, the SSRF leading edge offset (1322) is the distance from any point along the SSRF leading edge (1320) directly forward, in the Zcg direction, to the point at the lower edge (520) of the face (500). Thus, the SSRF leading edge offset (1322) may vary along the length of the SSRF leading edge (1320), or it may be constant if the curvature of SSRF leading edge (1320) matches the curvature of the lower edge (520) of the face (500). Nonetheless, there will always be a minimum SSRF leading edge offset (1322) at the point along the SSRF leading edge (1320) that is the closest to the corresponding point directly in front of it on the face lower edge (520), and there will be a maximum SSRF leading edge offset (1322) at the point along the SSRF leading edge (1320) that is the farthest from the corresponding point directly in front of it on the face lower edge (520). Generally, the maximum CSRF leading edge offset (1122) and the maximum SSRF leading edge offset (1322) will be less than seventy-five percent of the face height. For the purposes of this application and ease of definition, the face top edge (510) is the series of points along the top of the face (500) at which the vertical face roll becomes less than one inch, and similarly the face lower edge (520) is the series of points along the bottom of the face (500) at which the vertical face roll becomes less than one inch.

In this particular embodiment, the minimum CSRF leading edge offset (1122) is less than the face height, while the minimum SSRF leading edge offset (1322) is at least two percent of the face height. In an even further embodiment, the maximum CSRF leading edge offset (1122) is also less than the face height. Yet another embodiment incorporates a minimum CSRF leading edge offset (1122) that is at least ten percent of the face height, and the minimum CSRF width (1140) is at least fifty percent of the minimum CSRF leading edge offset (1122). A still further embodiment more narrowly defines the minimum CSRF leading edge offset (1122) as being at least twenty percent of the face height.

Likewise, many embodiments are directed to advantageous relationships of the sole located SRF (1300). For instance, in one embodiment, the minimum SSRF leading edge offset (1322) is at least ten percent of the face height, and the minimum SSRF width (1340) is at least fifty percent of the minimum SSRF leading edge offset (1322). Even further, another embodiment more narrowly defines the minimum SSRF leading edge offset (1322) as being at least twenty percent of the face height.

Still further building upon the relationships among the CSRF leading edge offset (1122), the SSRF leading edge offset (1322), and the face height, one embodiment further includes an engineered impact point (EIP) having a Yeip coordinate such that the difference between Yeip and Ycg is less than 0.5 inches and greater than −0.5 inches; a Xeip coordinate such that the difference between Xeip and Xcg is less than 0.5 inches and greater than −0.5 inches; and a Zeip coordinate such that the total of Zeip and Zcg is less than 2.0 inches. These relationships among the location of the engineered impact point (EIP) and the location of the center of gravity (CG) in combination with the leading edge locations of the crown located SRF (1100) and the sole located SRF (1300) promote stability at impact, while accommodating desirable deflection of the SRFs (1100, 1300) and the face (500), while also maintaining the durability of the club head (400) and reducing the peak stress experienced in the face (500).

Figure 28:
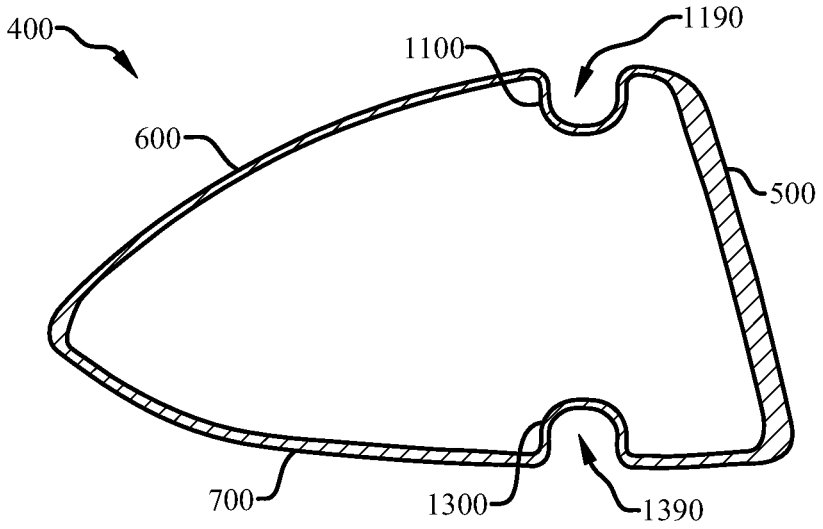
FIG. 28 shows a partial cross-sectional view of an embodiment of the present invention, not to scale.
Figure 29:
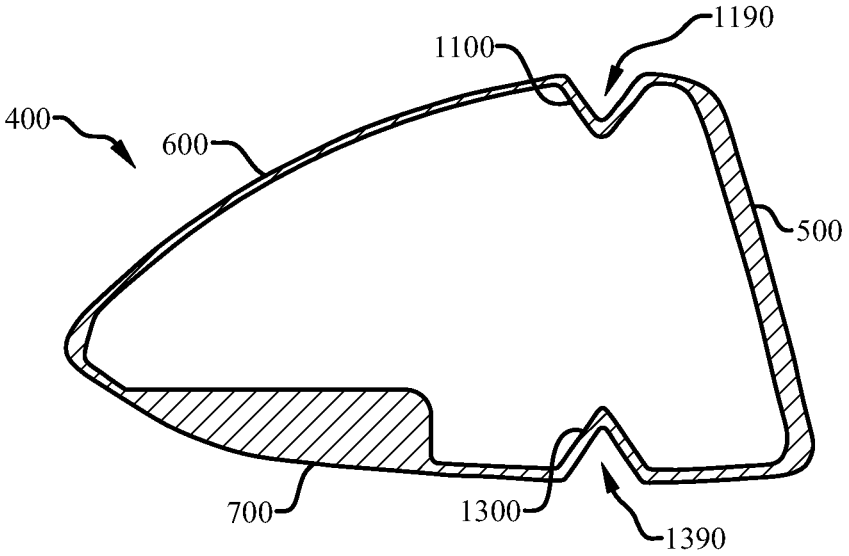
FIG. 29 shows a partial cross-sectional view of an embodiment of the present invention, not to scale.
Figure 40:
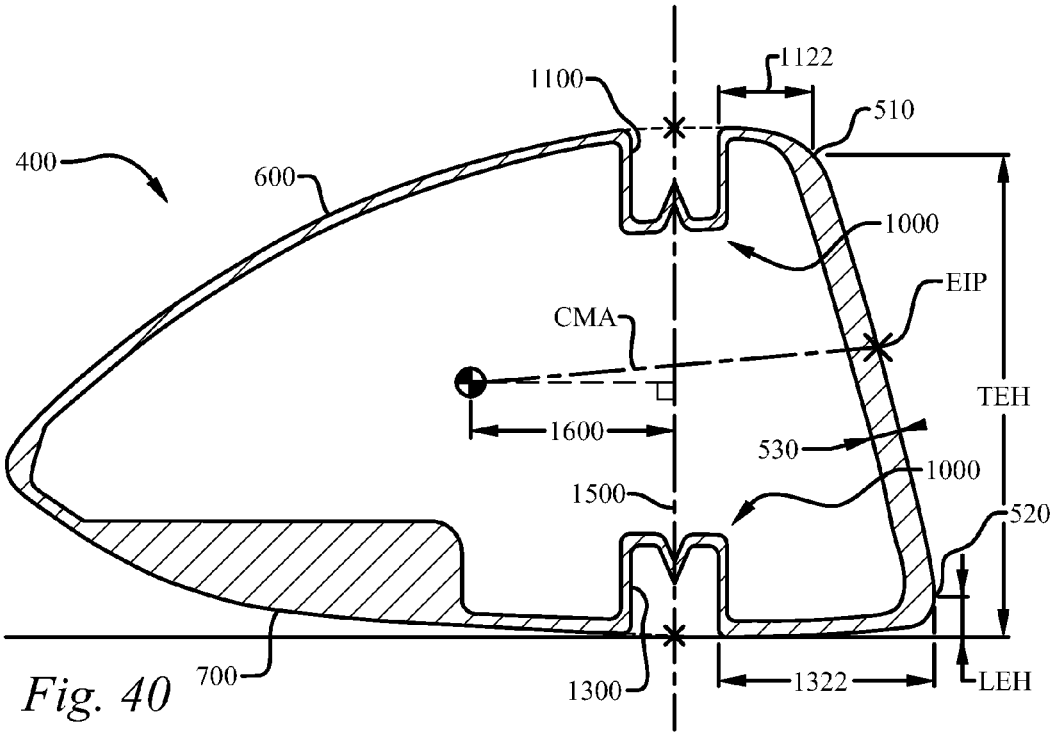
FIG. 40 shows a partial cross-sectional view of an embodiment of the present invention, not to scale.
Figure 41:
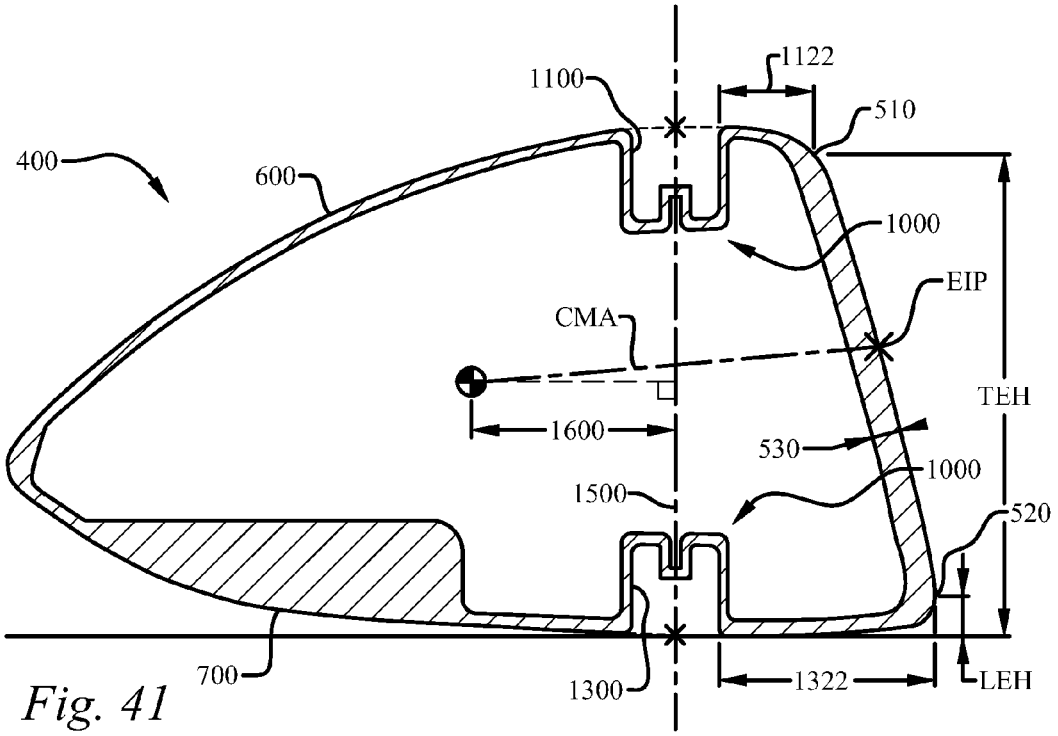
FIG. 41 shows a partial cross-sectional view of an embodiment of the present invention, not to scale.
Figure 42:
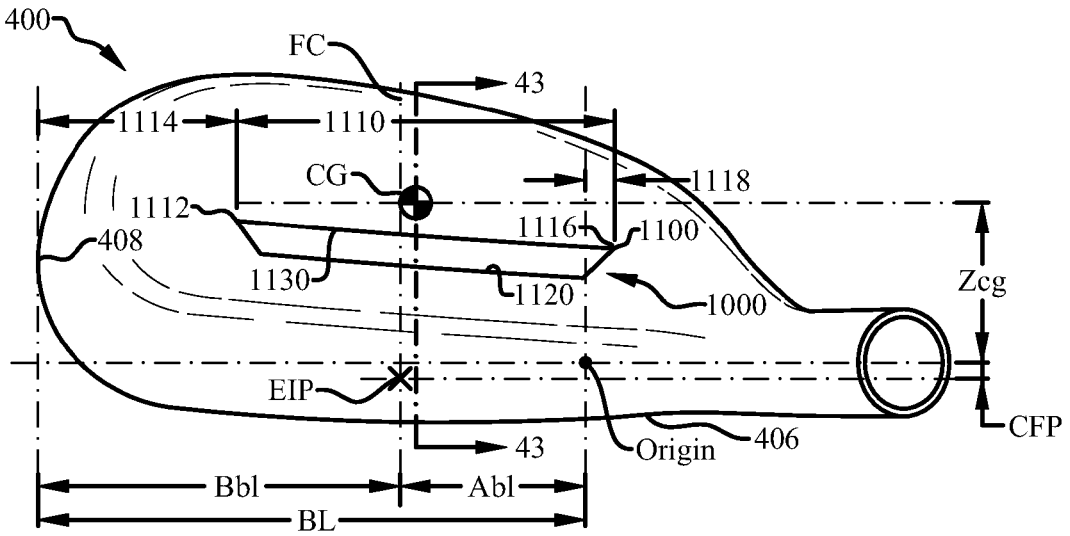
FIG. 42 shows a top plan view of an embodiment of the present invention, not to scale.
Figure 43:
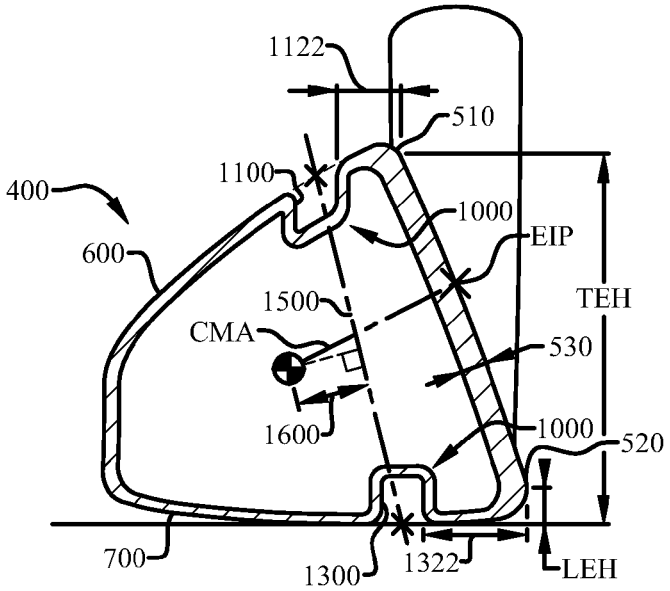
FIG. 43 shows a partial cross-sectional view of an embodiment of the present invention, not to scale.

While the location of the crown located SRF (1100) and the sole located SRF (1300) is important in achieving these objectives, the size of the crown located SRF (1100) and the sole located SRF (1300) also plays a role. In one particular long blade length embodiment directed to fairway wood type golf clubs and hybrid type golf clubs, illustrated in FIGS. 42 and 43, the golf club head (400) has a blade length (BL) of at least 3.0 inches with a heel blade length section (Abl) of at least 0.8 inches. In this embodiment, preferable results are obtained when the CSRF length (1110) is at least as great as the heel blade length section (Abl), the SSRF length (1310) is at least as great as the heel blade length section (Abl), the maximum CSRF depth (1150) is at least ten percent of the Ycg distance, and the maximum SSRF depth (1350) is at least ten percent of the Ycg distance, thereby permitting adequate compression and/or flexing of the crown located SRF (1100) and sole located SRF (1300) to significantly reduce the stress on the face (500) at impact. It should be noted at this point that the cross-sectional profile of the crown located SRF (1100) and the sole mounted SRF (1300) may include any number of shapes including, but not limited to, a box-shape, as seen in FIG. 24, a smooth U-shape, as seen in FIG. 28, and a V-shape, as seen in FIG. 29. Further, the crown located SRF (1100) and the sole located SRF (1300) may include reinforcement areas as seen in FIGS. 40 and 41 to further selectively control the deformation of the SRFs (1100, 1300). Additionally, the CSRF length (1110) and the SSRF length (1310) are measured in the same direction as Xcg rather than along the curvature of the SRFs (1100, 1300), if curved.

The crown located SRF (1100) has a CSRF wall thickness (1160) and sole located SRF (1300) has a SSRF wall thickness (1360), as seen in FIG. 25. In most embodiments the CSRF wall thickness (1160) and the SSRF wall thickness (1360) will be at least 0.010 inches and no more than 0.150 inches. In particular embodiment has found that having the CSRF wall thickness (1160) and the SSRF wall thickness (1360) in the range often percent to sixty percent of the face thickness (530) achieves the required durability while still providing desired stress reduction in the face (500) and deflection of the face (500). Further, this range facilitates the objectives while not have a dilutive effect, nor overly increasing the weight distribution of the club head (400) in the vicinity of the SRFs (1100, 1300).

Further, the terms maximum CSRF depth (1150) and maximum SSRF depth (1350) are used because the depth of the crown located SRF (1100) and the depth of the sole located SRF (1300) need not be constant; in fact, they are likely to vary, as seen in FIGS. 32-35. Additionally, the end walls of the crown located SRF (1100) and the sole located SRF (1300) need not be distinct, as seen on the right and left side of the SRFs (1100, 1300) seen in FIG. 35, but may transition from the maximum depth back to the natural contour of the crown (600) or sole (700). The transition need not be smooth, but rather may be stepwise, compound, or any other geometry. In fact, the presence or absence of end walls is not necessary in determining the bounds of the claimed golf club. Nonetheless, a criteria needs to be established for identifying the location of the CSRF toe-most point (1112), the CSRF heel-most point (1116), the SSRF toe-most point (1312), and the SSRF heel-most point (1316); thus, when not identifiable via distinct end walls, these points occur where a deviation from the natural curvature of the crown (600) or sole (700) is at least ten percent of the maximum CSRF depth (1150) or maximum SSRF depth (1350). In most embodiments a maximum CSRF depth (1150) and a maximum SSRF depth (1350) of at least 0.100 inches and no more than 0.500 inches is preferred.

Figure 36:
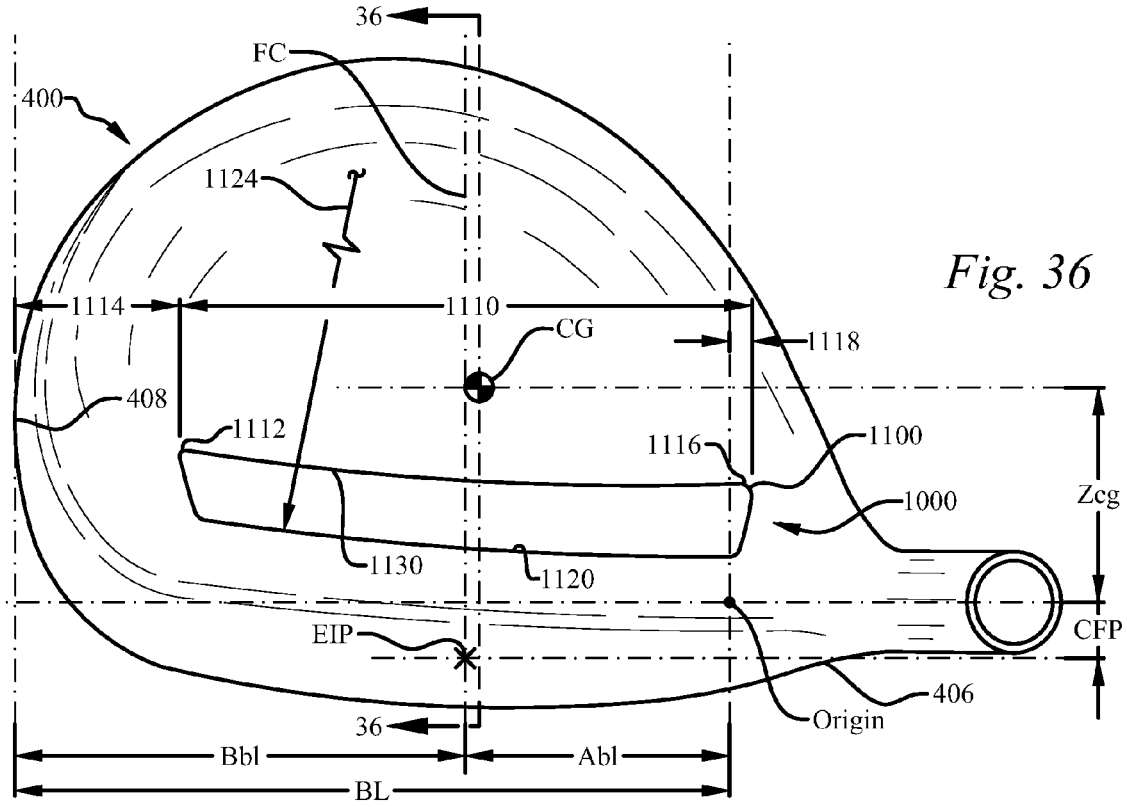
FIG. 36 shows a top plan view of an embodiment of the present invention, not to scale.
Figure 37:
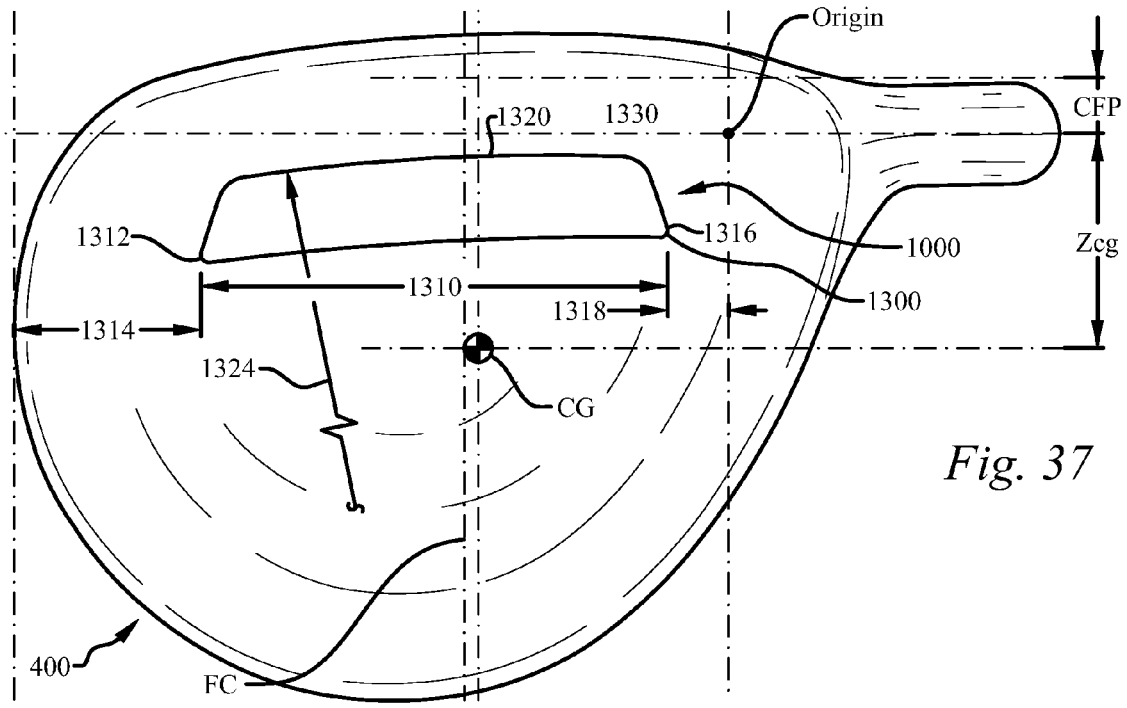
FIG. 37 shows a bottom plan view of an embodiment of the present invention, not to scale.
Figure 38:
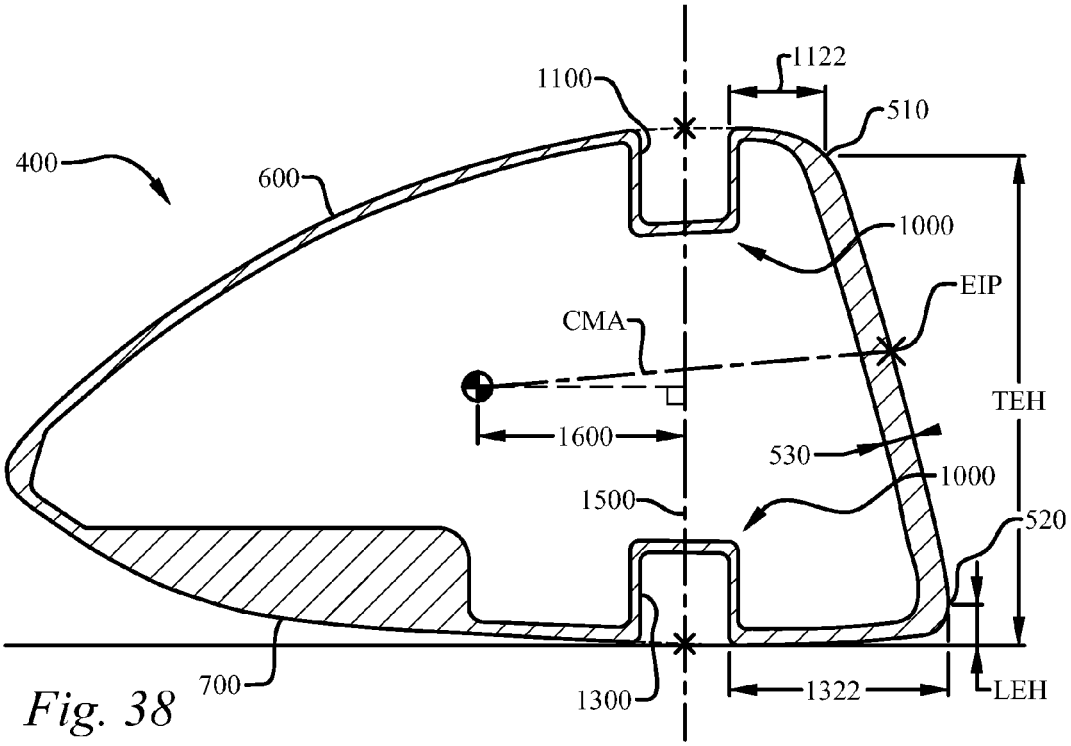
FIG. 38 shows a partial cross-sectional view of an embodiment of the present invention, not to scale.

The CSRF leading edge (1120) may be straight or may include a CSRF leading edge radius of curvature (1124), as seen in FIG. 36. Likewise, the SSRF leading edge (1320) may be straight or may include a SSRF leading edge radius of curvature (1324), as seen in FIG. 37. One particular embodiment incorporates both a curved CSRF leading edge (1120) and a curved SSRF leading edge (1320) wherein both the CSRF leading edge radius of curvature (1124) and the SSRF leading edge radius of curvature (1324) are within forty percent of the curvature of the bulge of the face (500). In an even further embodiment both the CSRF leading edge radius of curvature (1124) and the SSRF leading edge radius of curvature (1324) are within twenty percent of the curvature of the bulge of the face (500). These curvatures further aid in the controlled deflection of the face (500).

Figure 35:
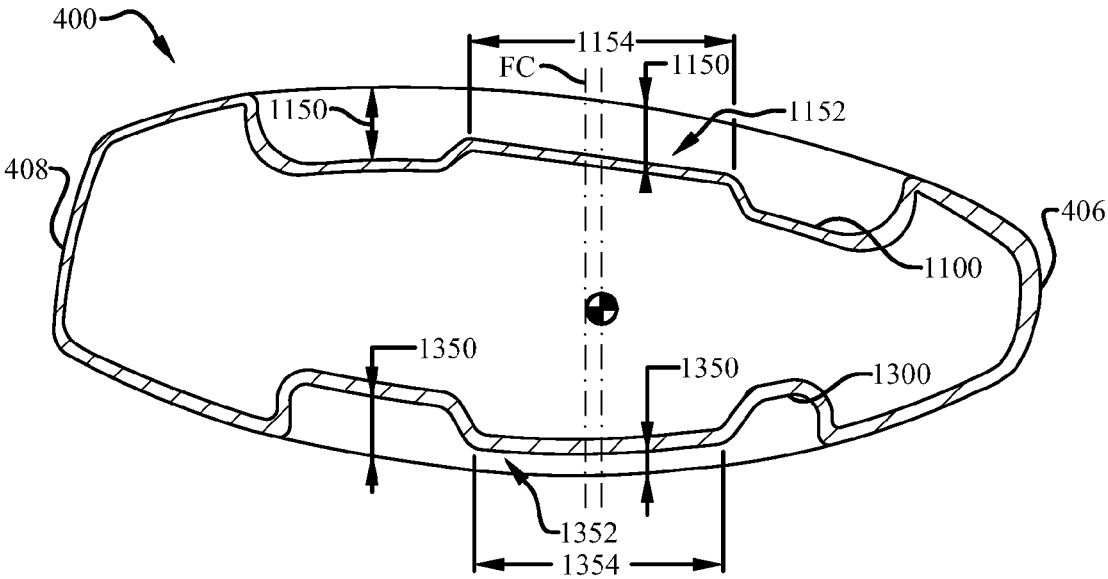
FIG. 35 shows a partial cross-sectional view of an embodiment of the present invention, not to scale.

One particular embodiment, illustrated in FIGS. 32-35, has a CSRF depth (1150) that is less at the face centerline (FC) than at a point on the toe side (408) of the face centerline (FC) and at a point on the heel side (406) of the face centerline (FC), thereby increasing the potential deflection of the face (500) at the heel side (406) and the toe side (408), where the COR is generally lower than the USGA permitted limit. In another embodiment, the crown located SRF (1100) and the sole located SRF (1300) each have reduced depth regions, namely a CSRF reduced depth region (1152) and a SSRF reduced depth region (1352), as seen in FIG. 35. Each reduced depth region is characterized as a continuous region having a depth that is at least twenty percent less than the maximum depth for the particular SRF (1100, 1300). The CSRF reduced depth region (1152) has a CSRF reduced depth length (1154) and the SSRF reduced depth region (1352) has a SSRF reduced depth length (1354). In one particular embodiment, each reduced depth length (1154, 1354) is at least fifty percent of the heel blade length section (Abl). A further embodiment has the CSRF reduced depth region (1152) and the SSRF reduced depth region (1352) approximately centered about the face centerline (FC), as seen in FIG. 35. Yet another embodiment incorporates a design wherein the CSRF reduced depth length (1154) is at least thirty percent of the CSRF length (1110), and the SSRF reduced depth length (1354) is at least thirty percent of the SSRF length (1310). In addition to aiding in achieving the objectives set out above, the reduced depth regions (1152, 1352) may improve the life of the SRFs (1100, 1300) and reduce the likelihood of premature failure, while increasing the COR at desirable locations on the face (500).

As seen in FIG. 25, the crown located SRF (1100) has a CSRF cross-sectional area (1170) and the sole located SRF (1300) has a SSRF cross-sectional area (1370). The cross-sectional areas are measured in cross-sections that run from the front portion (402) to the rear portion (404) of the club head (400) in a vertical plane. Just as the cross-sectional profiles (1190, 1390) of FIGS. 28 and 29 may change throughout the CSRF length (1110) and the SSRF length (1310), the CSRF cross-sectional area (1170) and the SSRF cross-sectional area (1370) may also vary along the lengths (1110, 1310). In fact, in one particular embodiment, the CSRF cross-sectional area (1170) is less at the face centerline (FC) than at a point on the toe side (408) of the face centerline (FC) and a point on the heel side (406) of the face centerline (FC). Similarly, in another embodiment, the SSRF cross-sectional area (1370) is less at the face centerline than at a point on the toe side (408) of the face centerline (FC) and a point on the heel side (406) of the face centerline (FC); and yet a third embodiment incorporates both of the prior two embodiments related to the CSRF cross-sectional area (1170) and the SSRF cross-sectional area (1370). In one particular embodiment, the CSRF cross-sectional area (1170) and the SSRF cross-sectional area (1370) fall within the range of 0.005 square inches to 0.375 square inches. Additionally, the crown located SRF (1100) has a CSRF volume and the sole located SRF (1300) has a SSRF volume. In one embodiment the combined CSRF volume and SSRF volume is at least 0.5 percent of the club head volume and less than 10 percent of the club head volume, as this range facilitates the objectives while not have a dilutive effect, nor overly increasing the weight distribution of the club head (400) in the vicinity of the SRFs (1100, 1300).

Now, in another separate embodiment seen in FIGS. 36 and 37, a CSRF origin offset (1118) is defined as the distance from the origin point to the CSRF heel-most point (1116) in the same direction as the Xcg distance such that the CSRF origin offset (1118) is a positive value when the CSRF heel-most point (1116) is located toward the toe side (408) of the golf club head (400) from the origin point, and the CSRF origin offset (1118) is a negative value when the CSRF heel-most point (1116) is located toward the heel side (406) of the golf club head (400) from the origin point. Similarly, in this embodiment, a SSRF origin offset (1318) is defined as the distance from the origin point to the SSRF heel-most point (1316) in the same direction as the Xcg distance such that the SSRF origin offset (1318) is a positive value when the SSRF heel-most point (1316) is located toward the toe side (408) of the golf club head (400) from the origin point, and the SSRF origin offset (1318) is a negative value when the SSRF heel-most point (1316) is located toward the heel side (406) of the golf club head (400) from the origin point.

In one particular embodiment, seen in FIG. 37, the SSRF origin offset (1318) is a positive value, meaning that the SSRF heel-most point (1316) stops short of the origin point. Further, yet another separate embodiment is created by combining the embodiment illustrated in FIG. 36 wherein the CSRF origin offset (1118) is a negative value, in other words the CSRF heel-most point (1116) extends past the origin point, and the magnitude of the CSRF origin offset (1118) is at least five percent of the heel blade length section (Abl). However, an alternative embodiment incorporates a CSRF heel-most point (1116) that does not extend past the origin point and therefore the CSRF origin offset (1118) is a positive value with a magnitude of at least five percent of the heel blade length section (Abl). In these particular embodiments, locating the CSRF heel-most point (1116) and the SSRF heel-most point (1316) such that they are no closer to the origin point than five percent of the heel blade length section (Abl) is desirable in achieving many of the objectives discussed herein over a wide range of ball impact locations.

Still further embodiments incorporate specific ranges of locations of the CSRF toe-most point (1112) and the SSRF toe-most point (1312) by defining a CSRF toe offset (1114) and a SSRF toe offset (1314), as seen in FIGS. 36 and 37. The CSRF toe offset (1114) is the distance measured in the same direction as the Xcg distance from the CSRF toe-most point (1112) to the most distant point on the toe side (408) of golf club head (400) in this direction, and likewise the SSRF toe offset (1314) is the distance measured in the same direction as the Xcg distance from the SSRF toe-most point (1312) to the most distant point on the toe side (408) of golf club head (400) in this direction. One particular embodiment found to produce preferred face stress distribution and compression and flexing of the crown located SRF (1100) and the sole located SRF (1300) incorporates a CSRF toe offset (1114) that is at least fifty percent of the heel blade length section (Abl) and a SSRF toe offset (1314) that is at least fifty percent of the heel blade length section (Abl). In yet a further embodiment the CSRF toe offset (1114) and the SSRF toe offset (1314) are each at least fifty percent of a golf ball diameter; thus, the CSRF toe offset (1114) and the SSRF toe offset (1314) are each at 0.84 inches. These embodiments also minimally affect the integrity of the club head (400) as a whole, thereby ensuring the desired durability, particularly at the heel side (406) and the toe side (408) while still allowing for improved face deflection during off center impacts.

Even more embodiments now turn the focus to the size of the crown located SRF (1100) and the sole located SRF (1300). One such embodiment has a maximum CSRF width (1140) that is at least ten percent of the Zcg distance, and the maximum SSRF width (1340) is at least ten percent of the Zcg distance, further contributing to increased stability of the club head (400) at impact. Still further embodiments increase the maximum CSRF width (1140) and the maximum SSRF width (1340) such that they are each at least forty percent of the Zcg distance, thereby promoting deflection and selectively controlling the peak stresses seen on the face (500) at impact. An alternative embodiment relates the maximum CSRF depth (1150) and the maximum SSRF depth (1350) to the face height rather than the Zcg distance as discussed above. For instance, yet another embodiment incorporates a maximum CSRF depth (1150) that is at least five percent of the face height, and a maximum SSRF depth (1350) that is at least five percent of the face height. An even further embodiment incorporates a maximum CSRF depth (1150) that is at least twenty percent of the face height, and a maximum SSRF depth (1350) that is at least twenty percent of the face height, again, promoting deflection and selectively controlling the peak stresses seen on the face (500) at impact. In most embodiments a maximum CSRF width (1140) and a maximum SSRF width (1340) of at least 0.050 inches and no more than 0.750 inches is preferred.

Additional embodiments focus on the location of the crown located SRF (1100) and the sole located SRF (1300) with respect to a vertical plane defined by the shaft axis (SA) and the Xcg direction. One such embodiment has recognized improved stability and lower peak face stress when the crown located SRF (1100) and the sole located SRF (1300) are located behind the shaft axis plane. Further embodiments additionally define this relationship. In one such embodiment, the CSRF leading edge (1120) is located behind the shaft axis plane a distance that is at least twenty percent of the Zcg distance. Yet anther embodiment focuses on the location of the sole located SRF (1300) such that the SSRF leading edge (1320) is located behind the shaft axis plane a distance that is at least ten percent of the Zcg distance. An even further embodiment focusing on the crown located SRF (1100) incorporates a CSRF leading edge (1120) that is located behind the shaft axis plane a distance that is at least seventy-five percent of the Zcg distance. A similar embodiment directed to the sole located SRF (1300) has a SSRF leading edge (1320) that is located behind the shaft axis plane a distance that is at least seventy-five percent of the Zcg distance. Similarly, the locations of the CSRF leading edge (1120) and SSRF leading edge (1320) behind the shaft axis plane may also be related to the face height instead of the Zcg distance discussed above. For instance, in one embodiment, the CSRF leading edge (1120) is located a distance behind the shaft axis plane that is at least ten percent of the face height. A further embodiment focuses on the location of the sole located SRF (1300) such that the SSRF leading edge (1320) is located behind the shaft axis plane a distance that is at least five percent of the Zcg distance. An even further embodiment focusing on both the crown located SRF (1100) and the sole located SRF (1300) incorporates a CSRF leading edge (1120) that is located behind the shaft axis plane a distance that is at least fifty percent of the face height, and a SSRF leading edge (1320) that is located behind the shaft axis plane a distance that is at least fifty percent of the face height.

Figure 39:
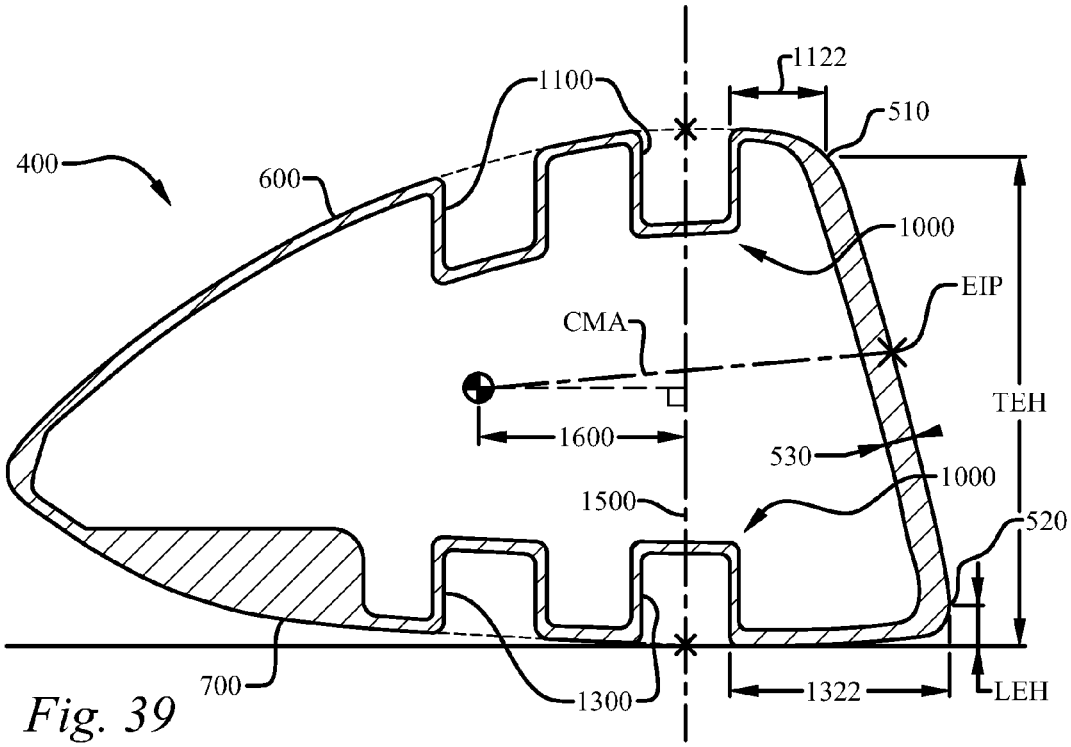
FIG. 39 shows a partial cross-sectional view of an embodiment of the present invention, not to scale.

The club head (400) is not limited to a single crown located SRF (1100) and a single sole located SRF (1300). In fact, many embodiments incorporating multiple crown located SRFs (1100) and multiple sole located SRFs (1300) are illustrated in FIGS. 30, 31, and 39, showing that the multiple SRFs (1100, 1300) may be positioned beside one another in a heel-toe relationship, or may be positioned behind one another in a front-rear orientation. As such, one particular embodiment includes at least two crown located SRFs (1100) positioned on opposite sides of the engineered impact point (EIP) when viewed in a top plan view, as seen in FIG. 31, thereby further selectively increasing the COR and improving the peak stress on the face (500). Traditionally, the COR of the face (500) gets smaller as the measurement point is moved further away from the engineered impact point (EIP); and thus golfers that hit the ball toward the heel side (406) or toe side (408) of the a golf club head do not benefit from a high COR. As such, positioning of the two crown located SRFs (1100) seen in FIG. 30 facilitates additional face deflection for shots struck toward the heel side (406) or toe side (408) of the golf club head (400). Another embodiment, as seen in FIG. 31, incorporates the same principles just discussed into multiple sole located SRFs (1300).

The impact of a club head (400) and a golf ball may be simulated in many ways, both experimentally and via computer modeling. First, an experimental process will be explained because it is easy to apply to any golf club head and is free of subjective considerations. The process involves applying a force to the face (500) distributed over a 0.6 inch diameter centered about the engineered impact point (EIP). A force of 4000 lbf is representative of an approximately 100 mph impact between a club head (400) and a golf ball, and more importantly it is an easy force to apply to the face and reliably reproduce. The club head boundary condition consists of fixing the rear portion (404) of the club head (400) during application of the force. In other words, a club head (400) can easily be secured to a fixture within a material testing machine and the force applied. Generally, the rear portion (404) experiences almost no load during an actual impact with a golf ball, particularly as the "front-to-back" dimension (FB) increases. The peak deflection of the face (500) under the force is easily measured and is very close to the peak deflection seen during an actual impact, and the peak deflection has a linear correlation to the COR. A strain gauge applied to the face (500) can measure the actual stress. This experimental process takes only minutes to perform and a variety of forces may be applied to any club head (400); further, computer modeling of a distinct load applied over a certain area of a club face (500) is much quicker to simulate than an actual dynamic impact.

Figure 44:
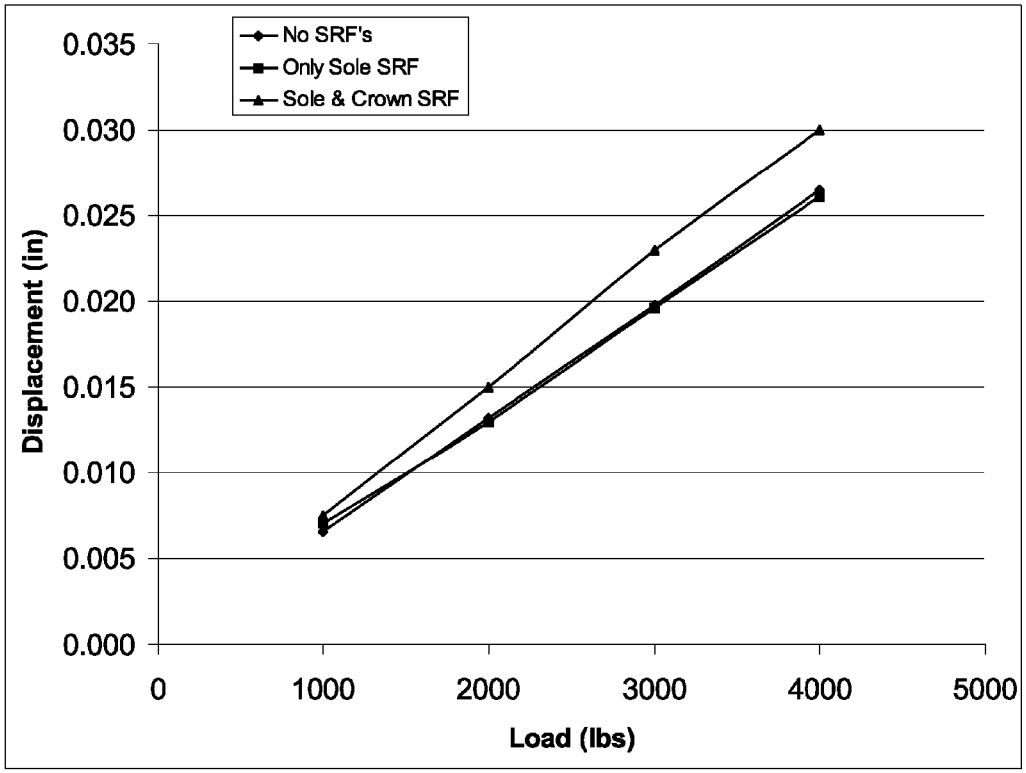
FIG. 44 shows a graph of face displacement versus load.
Figure 45:
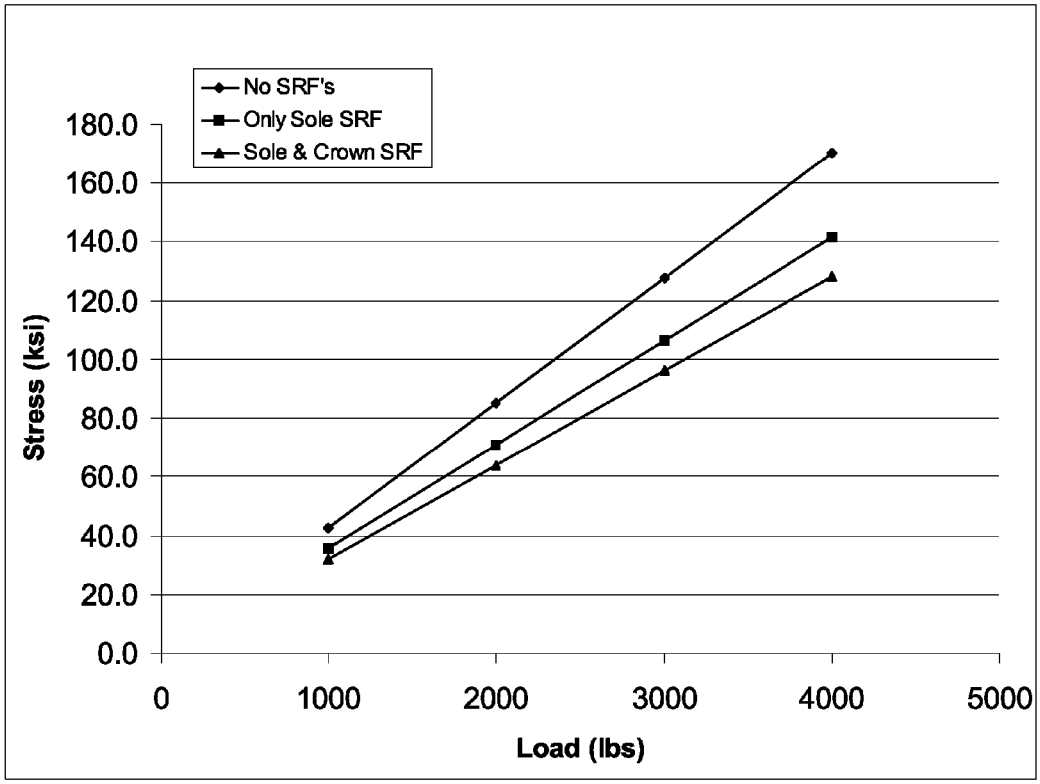
FIG. 45 shows a graph of peak stress on the face versus load.

A graph of displacement versus load is illustrated in FIG. 44 for a club head having no stress reducing feature (1000), a club head (400) having only a sole located SRF (1300), and a club head (400) having both a crown located SRF (1100) and a sole located SRF (1300), at the following loads of 1000 lbf, 2000 lbf, 3000 lbf, and 4000 lbf, all of which are distributed over a 0.6 inch diameter area centered on the engineered impact point (EIP). The face thickness (530) was held a constant 0.090 inches for each of the three club heads. The graph of FIG. 44 nicely illustrates that having only a sole located SRF (1300) has virtually no impact on the displacement of the face (500). However, incorporation of a crown located SRF (1100) and a sole located SRF (1300) as described herein increases face deflection by over 11% at the 4000 lbf load level, from a value of 0.027 inches to 0.030 inches. In one particular embodiment, the increased deflection resulted in an increase in the characteristic time (CT) of the club head from 187 microseconds to 248 microseconds. A graph of peak face stress versus load is illustrated in FIG. 45 for the same three variations just discussed with respect to FIG. 44. FIG. 45 nicely illustrates that incorporation of a crown located SRF (1100) and a sole located SRF (1300) as described herein reduces the peak face stress by almost 25% at the 4000 lbf load level, from a value of 170.4 ksi to 128.1 ksi. The stress reducing feature (1000) permits the use of a very thin face (500) without compromising the integrity of the club head (400). In fact, the face thickness (530) may vary from 0.050 inches, up to 0.120 inches.

Figure 46:
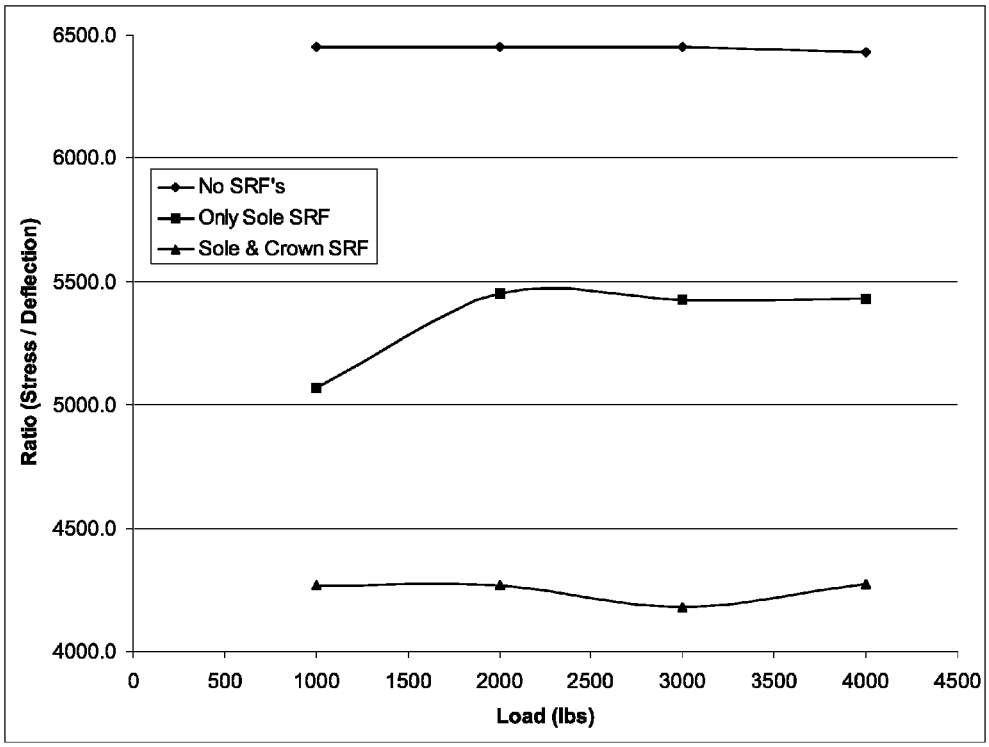
FIG. 46 shows a graph of the stress-to-deflection ratio versus load.

Combining the information seen in FIGS. 44 and 45, a new ratio may be developed; namely, a stress-to-deflection ratio of the peak stress on the face to the displacement at a given load, as seen in FIG. 46. In one embodiment, the stress-to-deflection ratio is less than 5000 ksi per inch of deflection, wherein the approximate impact force is applied to the face (500) over a 0.6 inch diameter, centered on the engineered impact point (EIP), and the approximate impact force is at least 1000 lbf and no more than 4000 lbf, the club head volume is less than 300 cc, and the face thickness (530) is less than 0.120 inches. In yet a further embodiment, the face thickness (530) is less than 0.100 inches and the stress-to-deflection ratio is less than 4500 ksi per inch of deflection; while an even further embodiment has a stress-to-deflection ratio that is less than 4300 ksi per inch of deflection.

In addition to the unique stress-to-deflection ratios just discussed, one embodiment of the present invention further includes a face (500) having a characteristic time of at least 220 microseconds and the head volume is less than 200 cubic centimeters. Even further, another embodiment goes even further and incorporates a face (500) having a characteristic time of at least 240 microseconds, a head volume that is less than 170 cubic centimeters, a face height between the maximum top edge height (TEH) and the minimum lower edge (LEH) that is less than 1.50 inches, and a vertical roll radius between 7 inches and 13 inches, which further increases the difficulty in obtaining such a high characteristic time, small face height, and small volume golf club head.

Those skilled in the art know that the characteristic time, often referred to as the CT, value of a golf club head is limited by the equipment rules of the United States Golf Association (USGA). The rules state that the characteristic time of a club head shall not be greater than 239 microseconds, with a maximum test tolerance of 18 microseconds. Thus, it is common for golf clubs to be designed with the goal of a 239 microsecond CT, knowing that due to manufacturing variability that some of the heads will have a CT value higher than 239 microseconds, and some will be lower. However, it is critical that the CT value does not exceed 257 microseconds or the club will not conform to the USGA rules. The USGA publication "Procedure for Measuring the Flexibility of a Golf Clubhead," Revision 2.0, Mar. 25, 2005, is the current standard that sets forth the procedure for measuring the characteristic time.

As previously explained, the golf club head (100) has a blade length (BL) that is measured horizontally from the origin point toward the toe side of the golf club head a distance that is parallel to the face and the ground plane (GP) to the most distant point on the golf club head in this direction. In one particular embodiment, the golf club head (100) has a blade length (BL) of at least 3.1 inches, a heel blade length section (Abl) is at least 1.1 inches, and a club moment arm (CMA) of less than 1.3 inches, thereby producing a long blade length golf club having reduced face stress, and improved characteristic time qualities, while not being burdened by the deleterious effects of having a large club moment arm (CMA), as is common in oversized fairway woods. The club moment arm (CMA) has a significant impact on the ball flight of off-center hits. Importantly, a shorter club moment arm (CMA) produces less variation between shots hit at the engineered impact point (EIP) and off-center hits. Thus, a golf ball struck near the heel or toe of the present invention will have launch conditions more similar to a perfectly struck shot. Conversely, a golf ball struck near the heel or toe of an oversized fairway wood with a large club moment arm (CMA) would have significantly different launch conditions than a ball struck at the engineered impact point (EIP) of the same oversized fairway wood. Generally, larger club moment arm (CMA) golf clubs impart higher spin rates on the golf ball when perfectly struck in the engineered impact point (EIP) and produce larger spin rate variations in off-center hits. Therefore, yet another embodiment incorporate a club moment arm (CMA) that is less than 1.1 inches resulting in a golf club with more efficient launch conditions including a lower ball spin rate per degree of launch angle, thus producing a longer ball flight.

Conventional wisdom regarding increasing the Zcg value to obtain club head performance has proved to not recognize that it is the club moment arm (CMA) that plays a much more significant role in golf club performance and ball flight. Controlling the club moments arm (CMA), along with the long blade length (BL), long heel blade length section (Abl), while improving the club head's ability to distribute the stresses of impact and thereby improving the characteristic time across the face, particularly off-center impacts, yields launch conditions that vary significantly less between perfect impacts and off-center impacts than has been seen in the past. In another embodiment, the ratio of the golf club head front-to-back dimension (FB) to the blade length (BL) is less than 0.925, as seen in FIGS. 6 and 13. In this embodiment, the limiting of the front-to-back dimension (FB) of the club head (100) in relation to the blade length (BL) improves the playability of the club, yet still achieves the desired high improvements in characteristic time, face deflection at the heel and toe sides, and reduced club moment arm (CMA). The reduced front-to-back dimension (FB), and associated reduced Zcg, of the present invention also significantly reduces dynamic lofting of the golf club head. Increasing the blade length (BL) of a fairway wood, while decreasing the front-to-back dimension (FB) and incorporating the previously discussed characteristics with respect to the stress reducing feature (1000), minimum heel blade length section (Abl), and maximum club moment arm (CMA), produces a golf club head that has improved playability that would not be expected by one practicing conventional design principles. In yet a further embodiment a unique ratio of the heel blade length section (Abl) to the golf club head front-to-back dimension (FB) has been identified and is at least 0.32. Yet another embodiment incorporates a ratio of the club moment arm (CMA) to the heel blade length section (Abl). In this embodiment the ratio of club moment arm (CMA) to the heel blade length section (Abl) is less than 0.9. Still a further embodiment uniquely characterizes the present fairway wood golf club head with a ratio of the heel blade length section (Abl) to the blade length (BL) that is at least 0.33. A further embodiment has recognized highly beneficial club head performance regarding launch conditions when the transfer distance (TD) is at least 10 percent greater than the club moment arm (CMA). Even further, a particularly effective range for fairway woods has been found to be when the transfer distance (TD) is 10 percent to 40 percent greater than the club moment arm (CMA). This range ensures a high face closing moment (MOIfc) such that bringing club head square at impact feels natural and takes advantage of the beneficial impact characteristics associated with the short club moment arm (CMA) and CG location.

Referring now to FIG. 10, in one embodiment it was found that a particular relationship between the top edge height (TEH) and the Ycg distance further promotes desirable performance and feel. In this embodiment a preferred ratio of the Ycg distance to the top edge height (TEH) is less than 0.40; while still achieving a long blade length of at least 3.1 inches, including a heel blade length section (Abl) that is at least 1.1 inches, a club moment arm (CMA) of less than 1.1 inches, and a transfer distance (TD) of at least 1.2 inches, wherein the transfer distance (TD) is between 10 percent to 40 percent greater than the club moment arm (CMA). This ratio ensures that the CG is below the engineered impact point (EIP), yet still ensures that the relationship between club moment arm (CMA) and transfer distance (TD) are achieved with club head design having a stress reducing feature (1000), a long blade length (BL), and long heel blade length section (Abl). As previously mentioned, as the CG elevation decreases the club moment arm (CMA) increases by definition, thereby again requiring particular attention to maintain the club moment arm (CMA) at less than 1.1 inches while reducing the Ycg distance, and a significant transfer distance (TD) necessary to accommodate the long blade length (BL) and heel blade length section (Abl). In an even further embodiment, a ratio of the Ycg distance to the top edge height (TEH) of less than 0.375 has produced even more desirable ball flight properties. Generally the top edge height (TEH) of fairway wood golf clubs is between 1.1 inches and 2.1 inches.

In fact, most fairway wood type golf club heads fortunate to have a small Ycg distance are plagued by a short blade length (BL), a small heel blade length section (Abl), and/or long club moment arm (CMA). With reference to FIG. 3, one particular embodiment achieves improved performance with the Ycg distance less than 0.65 inches, while still achieving a long blade length of at least 3.1 inches, including a heel blade length section (Abl) that is at least 1.1 inches, a club moment arm (CMA) of less than 1.1 inches, and a transfer distance (TD) of at least 1.2 inches, wherein the transfer distance (TD) is between 10 percent to 40 percent greater than the club moment arm (CMA). As with the prior disclosure, these relationships are a delicate balance among many variables, often going against traditional club head design principles, to obtain desirable performance. Still further, another embodiment has maintained this delicate balance of relationships while even further reducing the Ycg distance to less than 0.60 inches.

As previously touched upon, in the past the pursuit of high MOIy fairway woods led to oversized fairway woods attempting to move the CG as far away from the face of the club, and as low, as possible. With reference again to FIG. 8, this particularly common strategy leads to a large club moment arm (CMA), a variable that the present embodiment seeks to reduce. Further, one skilled in the art will appreciate that simply lowering the CG in FIG. 8 while keeping the Zcg distance, seen in FIGS. 2 and 6, constant actually increases the length of the club moment arm (CMA). The present invention is maintaining the club moment arm (CMA) at less than 1.1 inches to achieve the previously described performance advantages, while reducing the Ycg distance in relation to the top edge height (TEH); which effectively means that the Zcg distance is decreasing and the CG position moves toward the face, contrary to many conventional design goals.

As explained throughout, the relationships among many variables play a significant role in obtaining the desired performance and feel of a golf club. One of these important relationships is that of the club moment arm (CMA) and the transfer distance (TD). One particular embodiment has a club moment arm (CMA) of less than 1.1 inches and a transfer distance (TD) of at least 1.2 inches; however in a further particular embodiment this relationship is even further refined resulting in a fairway wood golf club having a ratio of the club moment arm (CMA) to the transfer distance (TD) that is less than 0.75, resulting in particularly desirable performance. Even further performance improvements have been found in an embodiment having the club moment arm (CMA) at less than 1.0 inch, and even more preferably, less than 0.95 inches. A somewhat related embodiment incorporates a mass distribution that yields a ratio of the Xcg distance to the Ycg distance of at least two.

A further embodiment achieves a Ycg distance of less than 0.65 inches, thereby requiring a very light weight club head shell so that as much discretionary mass as possible may be added in the sole region without exceeding normally acceptable head weights, as well as maintaining the necessary durability. In one particular embodiment this is accomplished by constructing the shell out of a material having a density of less than 5 g/cm$^3$, such as titanium alloy, nonmetallic composite, or thermoplastic material, thereby permitting over one-third of the final club head weight to be discretionary mass located in the sole of the club head. One such nonmetallic composite may include composite material such as continuous fiber pre-preg material (including thermosetting materials or thermoplastic materials for the resin). In yet another embodiment the discretionary mass is composed of a second material having a density of at least 15 g/cm$^3$, such as tungsten. An even further embodiment obtains a Ycg distance is less than 0.55 inches by utilizing a titanium alloy shell and at least 80 grams of tungsten discretionary mass, all the while still achieving a ratio of the Ycg distance to the top edge height (TEH) is less than 0.40, a blade length (BL) of at least 3.1 inches with a heel blade length section (Abl) that is at least 1.1 inches, a club moment arm (CMA) of less than 1.1 inches, and a transfer distance (TD) of at least 1.2 inches.

A further embodiment recognizes another unusual relationship among club head variables that produces a fairway wood type golf club exhibiting exceptional performance and feel. In this embodiment it has been discovered that a heel blade length section (Abl) that is at least twice the Ycg distance is desirable from performance, feel, and aesthetics perspectives. Even further, a preferably range has been identified by appreciating that performance, feel, and aesthetics get less desirable as the heel blade length section (Abl) exceeds 2.75 times the Ycg distance. Thus, in this one embodiment the heel blade length section (Abl) should be 2 to 2.75 times the Ycg distance.

Similarly, a desirable overall blade length (BL) has been linked to the Ycg distance. In yet another embodiment preferred performance and feel is obtained when the blade length (BL) is at least 6 times the Ycg distance. Such relationships have not been explored with conventional golf clubs because exceedingly long blade lengths (BL) would have resulted. Even further, a preferable range has been identified by appreciating that performance and feel become less desirable as the blade length (BL) exceeds 7 times the Ycg distance. Thus, in this one embodiment the blade length (BL) should be 6 to 7 times the Ycg distance.

Just as new relationships among blade length (BL) and Ycg distance, as well as the heel blade length section (Abl) and Ycg distance, have been identified; another embodiment has identified relationships between the transfer distance (TD) and the Ycg distance that produce a particularly playable golf club. One embodiment has achieved preferred performance and feel when the transfer distance (TD) is at least 2.25 times the Ycg distance. Even further, a preferable range has been identified by appreciating that performance and feel deteriorate when the transfer distance (TD) exceeds 2.75 times the Ycg distance. Thus, in yet another embodiment the transfer distance (TD) should be within the relatively narrow range of 2.25 to 2.75 times the Ycg distance for preferred performance and feel.

All the ratios used in defining embodiments of the present invention involve the discovery of unique relationships among key club head engineering variables that are inconsistent with merely striving to obtain a high MOIy or low CG using conventional golf club head design wisdom. Numerous alterations, modifications, and variations of the preferred embodiments disclosed herein will be apparent to those skilled in the art and they are all anticipated and contemplated to be within the spirit and scope of the instant invention. Further, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

We claim:

1. A hollow golf club head (400) comprising:

(i) a face (500) positioned at a front portion (402) of the golf club head (400) where the golf club head (400) impacts a golf ball, opposite a rear portion (404) of the golf club head (400), wherein the face (400) includes an engineered impact point (EIP), a top edge height (TEH), and a lower edge height (LEH), wherein a face height between the maximum top edge height (TEH) and the minimum lower edge (LEH) is less than 1.50 inches;

(ii) a sole (700) positioned at a bottom portion of the golf club head (400);

(iii) a crown (600) positioned at a top portion of the golf club head (400);

(iv) a bore having a center that defines a shaft axis (SA) which intersects with a horizontal ground plane (GP) to define an origin point, wherein the bore is located at a heel side (406) of the golf club head (400), and wherein a toe side (408) of the golf club head (400) is located opposite of the heel side (406);

(v) a center of gravity (CG) located:

(a) vertically toward the crown (600) of the golf club head (400) from the origin point a distance Ycg;

(b) horizontally from the origin point toward the toe side (408) of the golf club head (400) a distance Xcg that is generally parallel to the face (500) and the ground plane (GP); and (c) a distance Zcg from the origin toward the rear portion (404) in a direction generally orthogonal to the vertical direction used to measure Ycg and generally orthogonal to the horizontal direction used to measure Xcg; and (vi) a stress reducing feature (1000) including a sole located SRF (1300) located on the sole (700), wherein the sole located SRF (1300) has a SSRF length (1310) between a SSRF toe-most point (1312) and a SSRF heel-most point (1316), a SSRF leading edge (1320) having a SSRF leading edge offset (1322), a SSRF width (1340), and a SSRF depth (1350, wherein the maximum SSRF width (1340) is at least ten percent of the Zcg distance and the maximum SSRF depth (1350) is at least ten percent of the Ycg distance, and wherein the face (500) has a characteristic time of at least 220 microseconds, and a head volume is less than 200 cubic centimeters.

2. The hollow golf club head (400) of claim 1, wherein the head volume is less than 170 cubic centimeters and the characteristic time is at least 240 microseconds.

3. The hollow golf club head (400) of claim 1, wherein the minimum SSRF leading edge offset (1322) at least ten percent of the difference between the maximum top edge height (TEH) and the minimum lower edge height (LEH), and the maximum SSRF width (1340) is at least fifty percent of the minimum SSRF leading edge offset (1322).

4. The hollow golf club head (400) of claim 1, wherein at least a portion of the sole located SRF (1300) has a SSRF wall thickness (1360) that is less than sixty percent of a maximum face thickness (530).

5. The hollow golf club head (400) of claim 1, wherein at least a portion of the sole located SRF (1300) has a cross-sectional profile that includes a curved surface.

6. The hollow golf club head (400) of claim 5, wherein the portion of the sole located SRF (1300) having a curved cross-sectional profile is curved throughout at least fifty percent of the cross-sectional profile.

7. The hollow golf club head (400) of claim 6, wherein the portion of the sole located SRF (1300) having the curved cross-sectional profile has a U-shaped cross-sectional profile.

8. The hollow golf club head (400) of claim 1, wherein a portion of the golf club head is made of a nonmetallic composite material.

9. The hollow golf club head (400) of claim 1, wherein at least a portion of the sole located SRF (1300) has a cross-sectional profile that includes a straight wall portion angled upward toward the face (500).

10. The hollow golf club head (400) of claim 1, wherein the SSRF leading edge (1320) is curved and has a SSRF leading edge radius of curvature (1324) that is within twenty percent of a curvature of a bulge of the face (500).

11. The hollow golf club head (400) of claim 1, wherein the sole located SRF (1300) has a SSRF cross-sectional area (1370), and the SSRF cross-sectional area (1370) is less at a face centerline (FC) than at least one point on the toe side (408) of the face centerline (FC).

12. The hollow golf club head (400) of claim 1, wherein the sole located SRF (1300) has a SSRF cross-sectional area (1370), and the SSRF cross-sectional area (1370) is less at a face centerline (FC) than at least one point on the heel side (406) of the face centerline (FC).

13. The hollow golf club head (400) of claim 1, wherein the characteristic time is at least 240 microseconds, a club moment arm (CMA) is less than 1.1 inches, and the face (500) has a vertical roll radius of at least 7.0 inches and no more than 13.0 inches.

14. The hollow golf club head (400) of claim 13, wherein the club moment arm (CMA) is less than 0.95 inches.

15. The hollow golf club head (400) of claim 1, wherein the maximum SSRF width (1340) is at least forty percent of the Zcg distance.

16. The hollow golf club head (400) of claim 1, having a blade length (BL) of at least 3.0 inches when the blade length (BL) is measured horizontally from the origin point toward the toe side (408) of the golf club head (400) to the most distant point on the golf club head in this direction, wherein the blade length (BL) includes:

(a) a heel blade length section (Abl) measured in the same direction as the blade length (BL) from the origin point to the engineered impact point (EIP), wherein the heel blade length section (Abl) is at least 0.8 inches;

(b) a toe blade length section (Bbl); wherein (c) the SSRF length (1310) is at least as great as the heel blade length section (Abl); and (d) the maximum SSRF depth (1350) is at least five percent of the difference between the maximum top edge height (TEH) and the minimum lower edge height (LEH).

17. A hollow golf club head (400) comprising:

(i) a face (500) positioned at a front portion (402) of the golf club head (400) where the golf club head (400) impacts a golf ball, opposite a rear portion (404) of the golf club head (400), wherein the face (400) includes an engineered impact point (EIP), a top edge height (TEH), and a lower edge height (LEH);

(ii) a sole (700) positioned at a bottom portion of the golf club head (400);

(iii) a crown (600) positioned at a top portion of the golf club head (400);

(iv) a bore having a center that defines a shaft axis (SA) which intersects with a horizontal ground plane (GP) to define an origin point, wherein the bore is located at a heel side (406) of the golf club head (400), and wherein a toe side (408) of the golf club head (400) is located opposite of the heel side (406);

(v) a center of gravity (CG) located:

(a) vertically toward the crown (600) of the golf club head (400) from the origin point a distance Ycg;

(b) horizontally from the origin point toward the toe side (408) of the golf club head (400) a distance Xcg that is generally parallel to the face (500) and the ground plane (GP); and (c) a distance Zcg from the origin toward the rear portion (404) in a direction generally orthogonal to the vertical direction used to measure Ycg and generally orthogonal to the horizontal direction used to measure Xcg;

(vi) wherein the engineered impact point (EIP) is located:

(a) vertically toward the crown (600) of the golf club head (400) from the origin point a distance Yeip, wherein 0.5">(Yeip−Ycg)>−0.5";

(b) horizontally from the origin point toward the toe side (408) of the golf club head (400) a distance Xeip that is generally parallel to the face (500) and the ground plane (GP), wherein 0.5">(Xeip−Xcg)>−0.5"; and (c) a distance Zeip from the origin toward the face (500) in a direction generally orthogonal to the vertical direction used to measure Ycg and generally orthogonal to the horizontal direction used to measure Xcg, wherein (Zeip+Zcg)<2.0";

(vii) a blade length (BL) of at least 3.0 inches when the blade length (BL) is measured horizontally from the origin point toward the toe side (408) of the golf club head (400) to the most distant point on the golf club head in this direction, wherein the blade length (BL) includes a toe blade length section (Bbl) and a heel blade length section (Abl) measured in the same direction as the blade length (BL) from the origin point to the engineered impact point (EIP), wherein the heel blade length section (Abl) is at least 0.8 inches; and (viii) a stress reducing feature (1000) including a sole located SRF (1300) located on the sole (700), wherein the sole located SRF (1300) has a SSRF length (1310) between a SSRF toe-most point (1312) and a SSRF heel-most point (1316), a SSRF leading edge (1320) having a SSRF leading edge offset (1322), a SSRF width (1340), and a SSRF depth (1350, wherein (a) the maximum SSRF width (1340) is at least ten percent of the Zcg distance;

(b) the maximum SSRF depth (1350) is at least ten percent of the Ycg distance and at least five percent of the difference between the maximum top edge height (TEH) and the minimum lower edge height (LEH);

(c) the SSRF length (1310) is at least as great as the heel blade length section (Abl); and (d) at least a portion of the sole located SRF (1300) has a SSRF wall thickness (1360) that is less than sixty percent of a maximum face thickness (530), and the face (500) has a characteristic time of at least 220 microseconds.

18. The hollow golf club head (400) of claim 17, wherein the characteristic time is at least 240 microseconds and a head volume is less than 200 cubic centimeters.

19. The hollow golf club head (400) of claim 18, wherein the face (500) has a face height between the maximum top edge height (TEH) and the minimum lower edge (LEH) is less than 1.50 inches.

20. The hollow golf club head (400) of claim 19, wherein the head volume is less than 170 cubic centimeters and a club moment arm (CMA) from the CG to the engineered impact point (EIP) is less than 0.95 inches.

21. The hollow golf club head (400) of claim 17, wherein at least two points along the SSRF length (1310) have different SSRF leading edge offset (1322) values.

22. The hollow golf club head (400) of claim 17, wherein the maximum SSRF width (1340) is at least forty percent of the Zcg distance.

23. The hollow golf club head (400) of claim 17, wherein at least a portion of the sole located SRF (1300) has a cross-sectional profile that includes a curved surface wherein a curved cross-sectional profile is curved throughout at least fifty percent of the cross-sectional profile.

24. The hollow golf club head (400) of claim 23, wherein the portion of the sole located SRF (1300) having the curved cross-sectional profile has a U-shaped cross-sectional profile.

25. The hollow golf club head (400) of claim 17, wherein a portion of the golf club head is made of a nonmetallic composite material.

26. The hollow golf club head (400) of claim 17, wherein at least a portion of the sole located SRF (1300) has a cross-sectional profile that includes a straight wall portion angled upward toward the face (500).

27. The hollow golf club head (400) of claim 17, wherein the characteristic time is at least 240 microseconds and the face (500) has a vertical roll radius of at least 7.0 inches and no more than 13.0 inches.

28. The hollow golf club head (400) of claim 17, having a ratio of a front-to-back dimension (FB) to a blade length (BL) that is less than 0.925, wherein the blade length (BL) is at least 3.1 inches and has a heel blade length section (Abl) and a ratio of the club moment arm (CMA) to the heel blade length section (Abl) is less than 0.9.

* * * * *